US005622455A

United States Patent [19]

Anderson et al.

[11] Patent Number: 5,622,455

[45] Date of Patent: Apr. 22, 1997

[54] EARTHEN WORK WITH WIRE MESH FACING

[75] Inventors: Peter L. Anderson, North Reading, Mass.; Michael J. Cowell, Leesburg; Dan J. Hotek, Front Royal, both of Va.

[73] Assignee: Societe Civile des Brevets Henri Vidal, Paris, France

[21] Appl. No.: 475,045

[22] Filed: Jun. 7, 1995

Related U.S. Application Data

[63] Continuation-in-part of Ser. No. 472,885, Jun. 7, 1995, Ser. No. 466,806, Jun. 6, 1995, Pat. No. 5,494,379, and Ser. No. 382,985, Feb. 3, 1995, which is a continuation-in-part of Ser. No. 108,933, Aug. 18, 1993, Pat. No. 5,487,623, and Ser. No. 137,585, Oct. 15, 1993, Pat. No. 5,474,405, which is a continuation-in-part of Ser. No. 40,904, Mar. 31, 1993, Pat. No. 5,507,599, and Ser. No. 108,933, which is a continuation-in-part of Ser. No. 40,904, said Ser. No. 466,806, is a continuation-in-part of Ser. No. 156,053, Nov. 22, 1993, abandoned, which is a continuation-in-part of Ser. No. 114,098, Aug. 30, 1993, abandoned.

[51] Int. Cl.[6] ..... E02D 5/00; E02D 29/02

[52] U.S. Cl. ..... 405/262; 405/258; 405/284

[58] Field of Search ..... 405/284, 262, 405/30–33, 258

[56] References Cited

U.S. PATENT DOCUMENTS

| | | | |
|---|---|---|---|
| 4,117,686 | 10/1978 | Hilfiker | 405/30 X |
| 4,494,892 | 1/1985 | Wojciechowski | 405/284 X |
| 4,643,618 | 2/1987 | Hilfiker et al. | 405/284 X |
| 4,952,098 | 8/1990 | Grayson et al. | 405/262 |
| 4,961,673 | 10/1990 | Pagano et al. | 405/262 X |
| 5,156,496 | 10/1992 | Vidal et al. | 405/284 X |
| 5,259,704 | 11/1993 | Orgorchock | 405/262 |
| 5,487,623 | 1/1996 | Anderson et al. | 405/286 |

OTHER PUBLICATIONS

"VSL Retained Earth Metal Facing Wall System Installation Manual" brochure, On information and belief, this document was submitted to the Florida Department of Transportion in 1991 or early 1992.

*Primary Examiner*—Tamara L. Graysay
*Assistant Examiner*—Frederick L. Lagman
*Attorney, Agent, or Firm*—Banner & Witcoff, Ltd.

[57] ABSTRACT

An earthen work bulk form construction has a wire mesh facing and granular compactable fill with stabilizing members projecting horizontally into the fill from the front facing. The front facing is comprised of modular shaped panels which form a mosaic pattern that enables construction of the wall with non-adjacent panels serving to facilitate and support adjacent panels. Connection of the stabilizing members to the front panels is effected through a quick engagement and locking handle bar connector. A handle bar connector is used for connecting a cast in place front wall to the front panels and bulk form.

49 Claims, 32 Drawing Sheets

FIG. 37
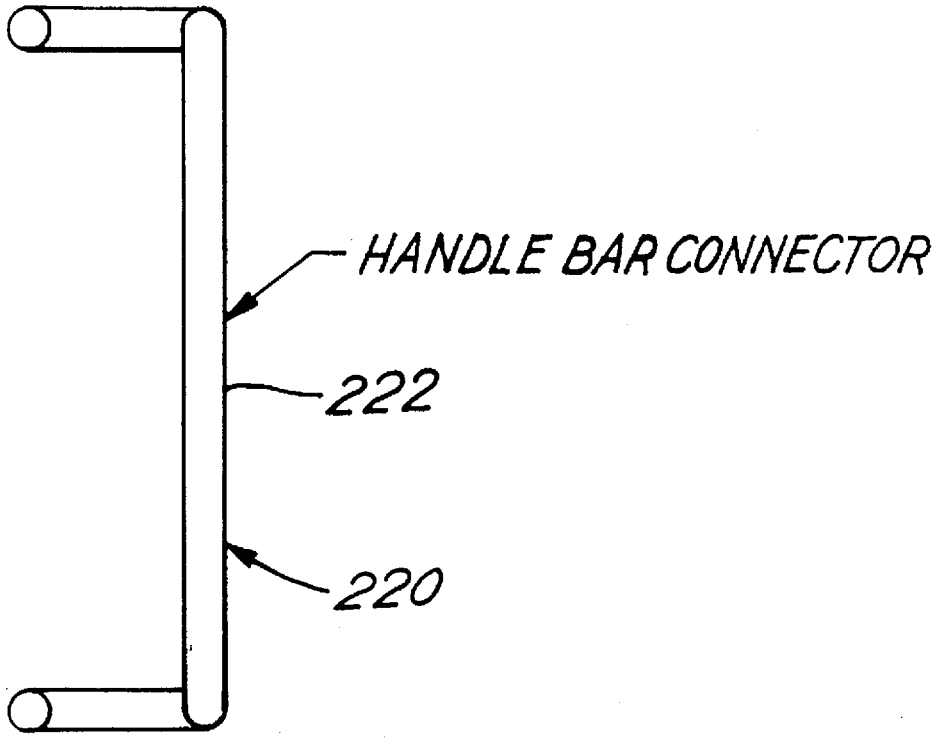
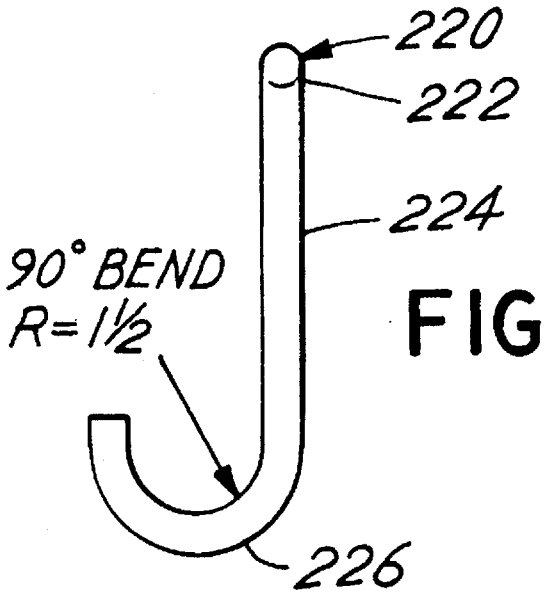
FIG. 36

EARTHEN WORK WITH WIRE MESH FACING

CROSS REFERENCE TO RELATED APPLICATION

This is a continuation-in-part application of Ser. No. 08/466,806, filed Jun. 6, 1995, now U.S. Pat. No. 5,494,379; which is a continuation-in-part application of Ser. No. 08/156,053, filed Nov. 22, 1993, abandoned; which is a continuation-in-part application of Ser. No. 08/114,098, filed Aug. 30, 1993, abandoned. This is also a continuation-in-part application of Ser. No. 08/382,985, filed Feb. 3, 1995, which is a continuation-in-part application of Ser. No. 08/108,933, filed Aug. 18, 1993, now U.S. Pat. No. 5,487,623, which is a continuation-in-part application of Ser. No. 08/040,904, filed Mar. 31, 1993, now U.S. Pat. No. 5,507,599. Ser. No. 08/382,985 is also a continuation-in-part application of Ser. No. 08/137,585, filed Oct. 15, 1993, now U.S. Pat. No. 5,474,405, which is a continuation-in-part application of Ser. No. 08/108,933, now U.S. Pat. No. 5,487,623, and Ser. No. 08/040,904, now U.S. Pat. No. 5,507,599. This is also a continuation-in-part application of Ser. No. 08/472,885, filed Jun. 7, 1995.

BACKGROUND OF THE INVENTION

This invention relates to an improved earthen work with a wire mesh facing or with a wire mesh facing having cast in place facing.

The construction of earthen works utilizing tensile members for earth stabilization by arranging such tension members generally horizontally in the earthen work bulk form or mass of particulate material is taught in various Vidal patents, including Vidal U.S. Pat. No. 3,421,326; U.S. Pat. No. 3,686,873 and others. Such an earthen work mass is thus comprised of tensile members or, alternatively, anchor members in combination with various types of precast panels or other facing members that define a front face of the earthen work mass. For example, an alternative to the use of panel members is disclosed in various patents including Hilfiker U.S. Pat. No. 4,117,686. There, a wire grid or mesh front facing construction is disclosed in combination with course rock backfill against the back side of the wire mesh front facing. The wire grid facing and earth stabilizing tensile members may comprise a continuous L-shaped grid as disclosed, for example, in Hilfiker U.S. Pat. No. 4,505,621. Layers of the L-shaped grids in combination with layers of particulate may thus define an entire mass or bulk form with a wire mesh facing.

Such various kinds of construction are also discussed in Pagano et al. U.S. Pat. No. 4,961,673. These prior art constructions, particularly those which use or utilize a wire mesh front facing, are especially useful for temporary structures although it is possible to fabricate such an earthen work bulk form as a generally permanent structure.

The ease of construction of such an earthen work bulk form is often complicated because the wire mesh forms relied upon for the construction are large, bulky and sometimes unwieldy. Thus, there has developed a need for an improved earthen work bulk form construction utilizing or having a wire mesh facing. The present invention comprises such a construction and a method for such a construction.

SUMMARY OF THE INVENTION

Briefly, the present invention comprises an earthen work bulk form construction having a wire mesh front facing and a granular, compactable fill which together define the three dimensional earthen work bulk form. The generally planar front face extends upwardly from a datum or foundation plane. The planar front face has a wire mesh facing which is connected to stabilizing tensile or anchoring members that project into the earthen work bulk form and interact with the particulate material forming the bulk form. The stabilizing members projecting into the earthen work bulk form are attached to the wire mesh facing to facilitate retention of the facing material on the bulk form. The stabilizing members also provide stability to the particulate material forming the bulk form.

A feature of the invention is the utilization of generally modular, rectangular panels of uniform length and height for forming the front wire mesh facing of the earthen work bulk form. These panels are arranged so that adjacent panels are juxtapositioned vertically one with respect to the other. In this manner, during the construction process of the earthen work bulk form, horizontally alternating front facing panels serve to connect with and support the facing panel therebetween. Consequently, the generally planar wire mesh facing panels can be maintained in a vertical condition during the construction process as earth stabilizing members are attached to the front facing panels and backfill is compacted behind those facing panels. Facing panels arranged vertically adjacent to one another form a continuous column of panels of generally uniform width.

The earth stabilizing members preferably comprise a pair of parallel arm, tension members which interlock with the front facing panels by means of a locking handle bar which connects simultaneously with each pair of tension members. The tension members thus may extend into the earthen work bulk form to provide a mechanically stabilized earthen work bulk form. The adjacent panels may be interlocked with one another through cooperative interaction of the stabilizing members and locking handle bar construction with the wire mesh facing of the adjacent panels. The stabilizing members and locking handle bar not only connect the tension members to the facing panels, but also serve to facilitate interconnection of adjacent facing wire mesh panels. The stabilizing members which project into the earthen work bulk form may be of different lengths, as shown schematically in FIG. 23, and different configurations in order to preclude the formation of bulges or other distortions in the panel members. They may also be used in greater or lesser density in the bulk form. Thus, the wire mesh facing may be custom designed and engineered to insure a planar front face surface.

Alternative locking handle bar constructions are disclosed including a construction which projects outwardly from the facing panels whereby a concrete facing may be cast in place against the facing panels connected thereto via the handle bars.

Thus, it is an object of the invention to provide an earthen work construction with a wire mesh facing wherein the facing is comprised of a series of generally uniformly sized, rectangular configured panels.

Yet a further object of the invention is to provide an earthen work bulk form construction which may incorporate stabilizing elements of varying configuration and size so as to insure a uniform front face for the bulk form.

Yet another object of the invention is to provide an improved earthen work bulk form construction having a wire mesh facing which is comprised of component parts that are easily manufactured, stored, shipped and assembled inasmuch as the majority of the component parts are flat panels and accessories to facilitate such construction, storage, shipping and assembly.

Yet another object of the invention is to provide an improved construction and method of construction for an earthen work bulk form having a wire mesh facing which may be assembled easily and quickly with a minimum amount of man power and machinery.

Yet a further object of the invention is to provide an improved earthen work bulk form having a wire mesh facing which incorporates a unique means for interconnecting tensile members in the earthen work mass to the front panel members comprising the wire mesh facing.

Yet another object of the invention is to interconnect facing panels such that tension in the facing panels can be passed to adjacent facing panels vertically and horizontally, and thus prevent outward bulging of the facing.

Yet another object of the invention is to interconnect vertically adjacent facing panels so as to allow for vertical slippage and thus accommodate consolidation of soil adjacent to the facing.

Another object of the invention is to provide a wall construction of the type generally described in combination with a cast in place front facing.

Another object of the invention is to provide means for connecting a wire mesh facing of an earthen work bulk form with a cast in place front facing.

These and other objects, advantages and features of the invention will be set forth in greater detail below.

BRIEF DESCRIPTION OF THE DRAWING

In the detailed description which follows reference will be made to the drawing comprised of the following figures:

FIG. 36 is a side view of an alternative reinforcing connector of the type depicted in FIG. 25 and used for a cast in place wall; and FIG. 37 is a top view of the connector of FIG. 36.

DETAILED DESCRIPTION OF THE PREFERRED EMBODIMENT

Overview

Figure 1:
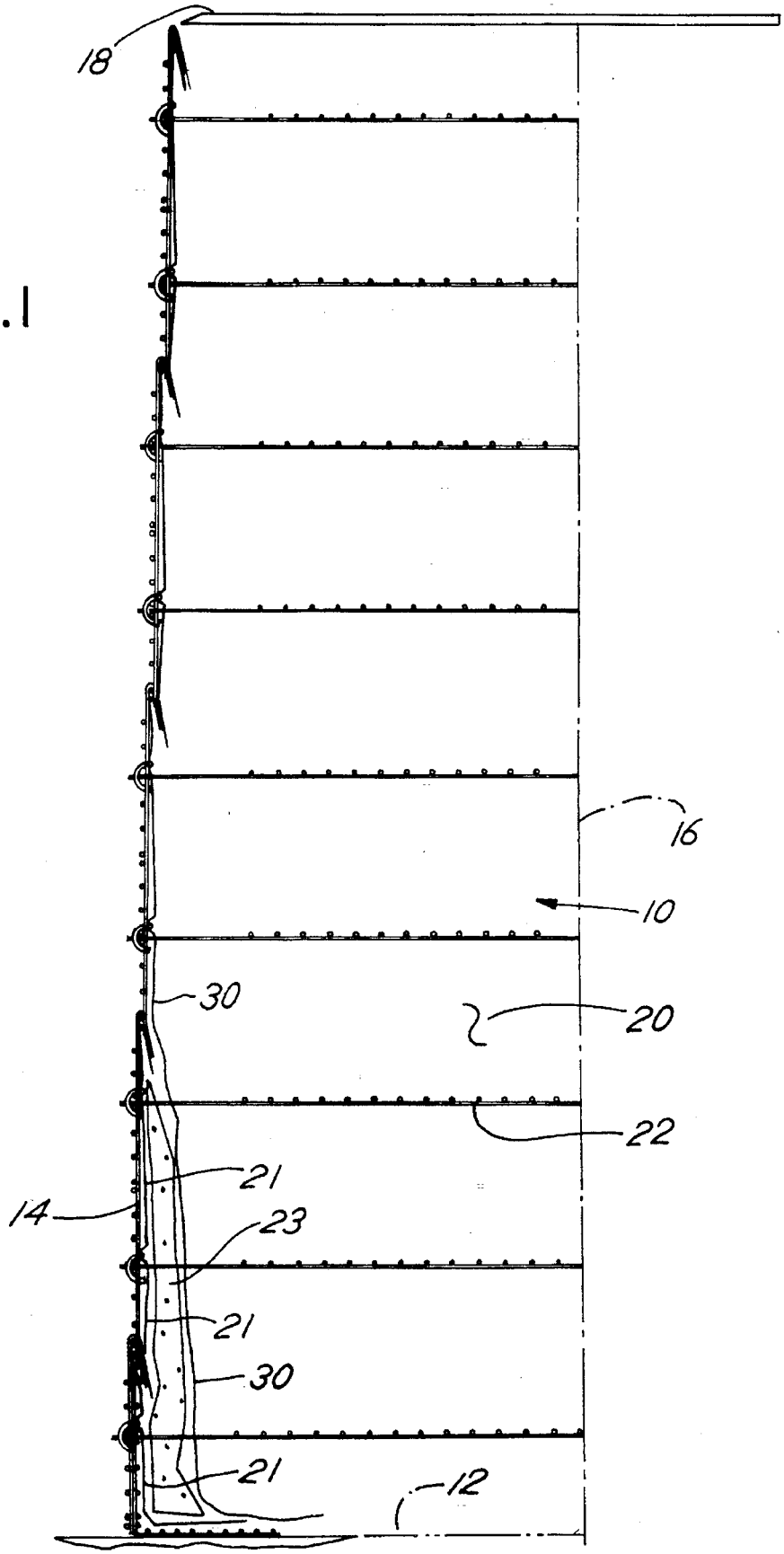
FIG. 1 is a cross-sectional, elevation of an earthen work bulk form made in accord with and utilizing the components of the present invention wherein the lower portion is constructed as a permanent structure and the upper portion is constructed as a temporary structure.
Figure 2:
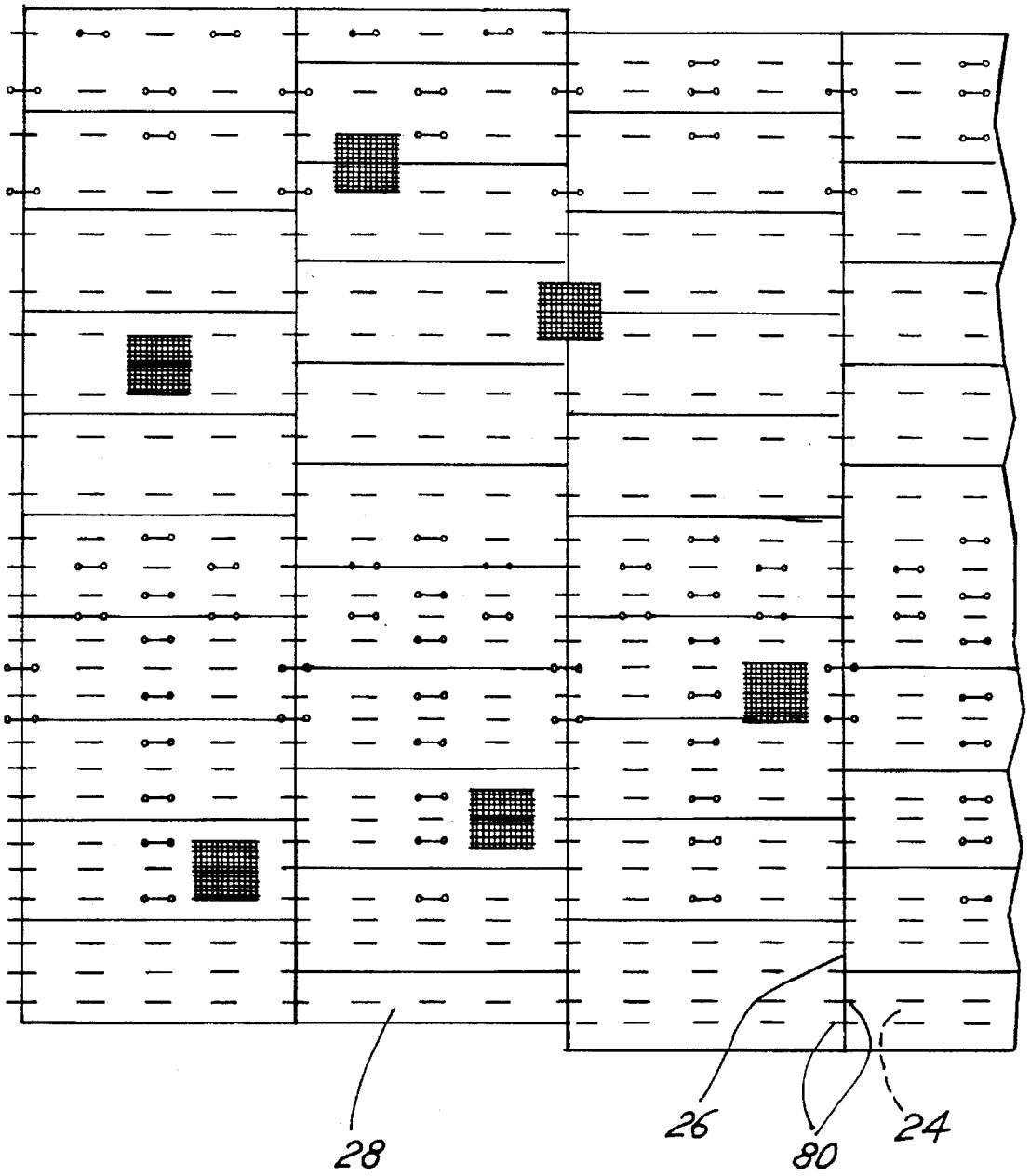
FIG. 2 is a front elevation of the earthen work bulk form of FIG. 1 detailing the configuration of the rectangular panels which form the wire mesh front face of the bulk form.

FIGS. 1 and 2 depict, in general, a typical earthen work bulk form 10 incorporating the invention. Specifically, earthen work bulk form 10 is defined by a lower datum plane 12, a front wire mesh or grid facing 14, an internal, back side boundary 16 and a top surface 18. The bulk form includes particulate material 20 which is generally compacted and which interacts with stabilizing members 22 dispersed throughout the bulk form 10 from the top surface 18 to the datum plane 12 and extending laterally from the front facing 14 generally horizontally toward the back side boundary 16. Boundary 16 abuts a cut soil surface or adjacent retained fill material.

The stabilizing members 22 may be of nonuniform length. Typically they extend the entire distance from the front face 14 to the backside boundary 16. However, in numerous instances, as will be discussed in greater detail below, the stabilizing members 22 may extend from the front face 14 partially toward the back side boundary 16. In most instances, the stabilizing members 22 are affixed to the front facing 14. The stabilizing members 22 are typically tension members which interact, at least in part by means of friction, with the compacted particulate 20. However, anchor members and other stabilizing members may be used as the stabilizing mechanism interactive with the particulate 20 constituting part of the bulk form 10.

FIG. 2 illustrates the general components which comprise the front facing 14 of the bulk form 10. These components include a base component 24 which has a vertical wire mesh panel 27 and a horizontal wire mesh panel 25. The horizontal wire mesh panel 25 is positioned on the datum plane 12.

The front facing 14 also includes full size generally planar, rectangular panels 26 and half size panels 28, which are also generally rectangular and which have a vertical extent approximately one half the vertical extent of the panels 26. The panels 26 and 28, as well as the base component 24, comprise a grid work of wire mesh or reinforcing bars. Thus, the grid work is comprised of wires and rods arranged generally at right angles with respect to each other to form a rectangular, cross-hatched pattern. However, the particular pattern for the formation of the panels 24, 26, 28 is not a limiting feature of the invention. The full size panel 26 and the half size panel 28 are preferably rectangular in shape and have dimensions which enable them to be easily transported and shipped on a flat bed truck or palette. For example, the full size panels 26 typically will have a width on the order of nine (9) feet and height on the order of forty (40) inches. The panels 26, 28 are thus generally modular in their configuration and rectangular as described.

FIG. 2 depicts, at various positions on the Figure, the cross hatch pattern of the separate rods and wires which form the panels 26, 28. The cross hatching is excluded from the majority of FIG. 2 for purposes of enhancing the clarity of the description. The remaining figures depicting the panels disclose the full array of wires and rods which are interconnected to form the panels 26, 28. Typically, the wires or rods have three (3) to five (5) inch spacing in both directions and comprise reinforcing bars of various gauges, for example, W8 grade reinforcing bars.

The upper portion of FIG. 1 depicts a construction wherein the drawing depicts two alternative embodiments in a single structure. It is noted that this depiction is for purposes of illustration, since the alternative embodiments are not normally combined. Rather they normally exist separately as single bulk forms. Referring again to FIG. 1 for temporary structures, the front face 14 typically includes a layer of filter cloth 30 on the inside thereof which maintains small grained particulate 20 within the earthen work bulk form 10. For permanent structures, it is appropriate to include extra screening 21 on the inside of the front face positioned against the inside of the front face 14 to enhance the retention of coarse particulate 23 within the bulk form 10. The filter cloth 30 is placed between the coarse particulate 23 and the small grained particulate 20 and is optional.

It is to be noted by reference to FIG. 2, that the panels 24, 26 and 28 define a series of side by side, generally vertical columns wherein the edges of the panels 24, 26 and 28 are aligned vertically. The panels such as panels 26, however, are not aligned horizontally, rather they are offset by one half of the panel height. Thus, non-adjacent panels 26 are aligned and are connected to a panel 26 therebetween and serve to support that panel 26 during the construction of the bulk form 10 in a manner to be described in more detail below. An important aspect of the construction is the fact that the rectangular panels 26 are alternated in the manner or pattern as depicted in FIG. 2 so that during the construction operation, non-adjacent panels serve to support adjacent panels as the earthen work bulk form is being built and the elevation thereof is increased during the construction operation. Half size panels 28 thus serve to start as well as top out each vertical column of panels.

Base Component

Figure 3:
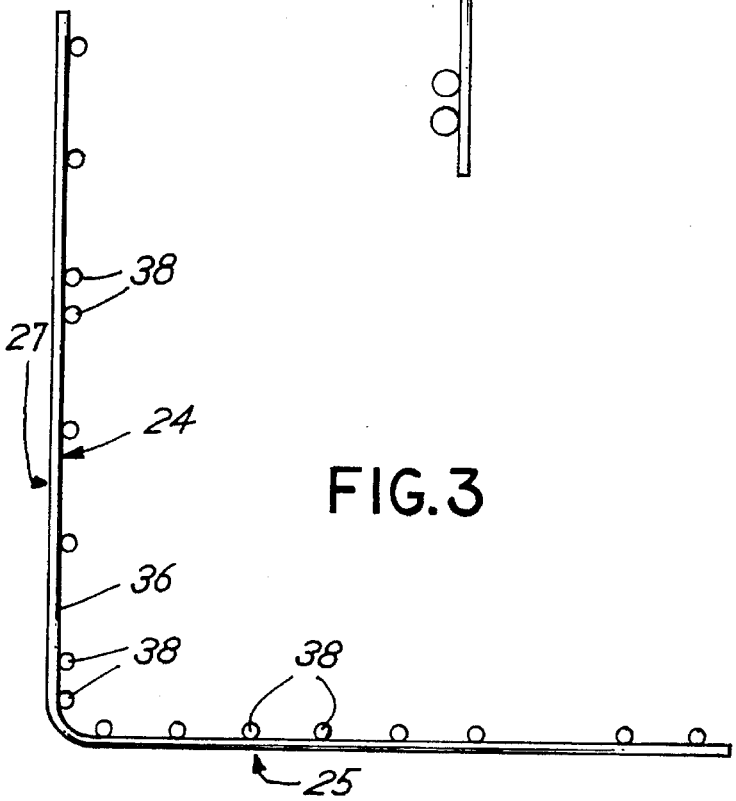
FIG. 3 is a side elevation of the wire mesh base component for the bulk form.
Figure 4:
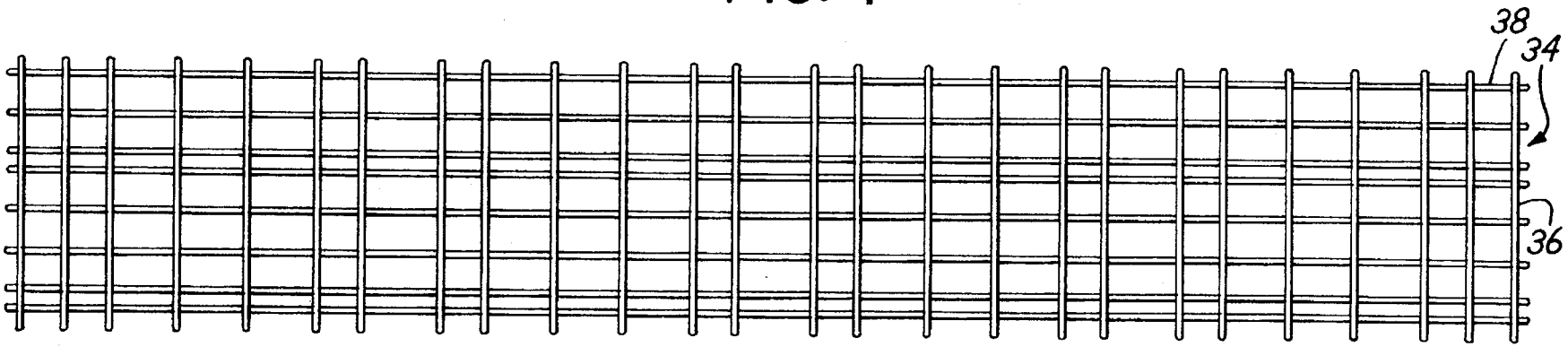
FIG. 4 is a front plan view of the base component of FIG. 3.

FIGS. 3 and 4 illustrate a base component 24. Base component 24 includes a generally horizontal support run 25 and a generally vertical front face run 27. The base component 24 is formed by L-shaped stringers or rods 36 which define the height of the front face run 27 and the horizontal extent of the horizontal run 25. Typically, the length of the horizontal run 25 is equal to or lesser than the height of the front face run 27. Cross bars 38 engage with the stringers 36 to complete the formation of the base panel 24. Cross bars 38 are arranged in preferred patterns as depicted in FIGS. 3 and 4. That is, the cross bars 38 attached to the horizontal run 25 are generally equally spaced and also positioned on the top surface or inside of the stringers 36. The horizontal run 25 is positioned on the datum plane 12 during the construction process. The cross bars 38 along the front face run 34 are arranged on the inside of the stringers 36 in a spaced pattern. At appropriate intervals, the cross bars 38 are positioned dosely adjacent to each other as depicted. Typically the spacing of the two most closely adjacent cross bars 38 is on the order of approximately one (1) inch. The cross bars 38 are otherwise spaced on the order of three (3) to five (5) inches. The stringers 36 are spaced laterally from one another on the order of three (3) to six (6) inches. In this manner, the base component provides an array or configuration of reinforcing bars having a pattern for the front face run 27 as depicted in FIG. 4.

Front Face Panels

Figure 5:
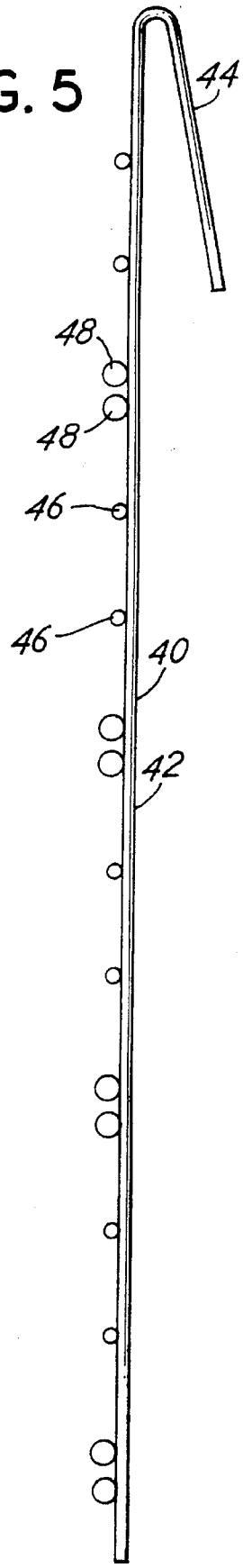
FIG. 5 is a side elevation of a full height front, wire mesh panel used in the construction of the earthen work bulk form.
Figure 7:
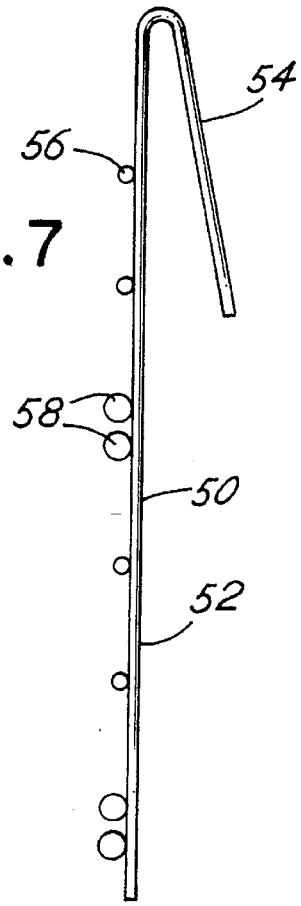
FIG. 7 is a side elevation of a half size panel of the type depicted in FIG. 5.
Figure 8:
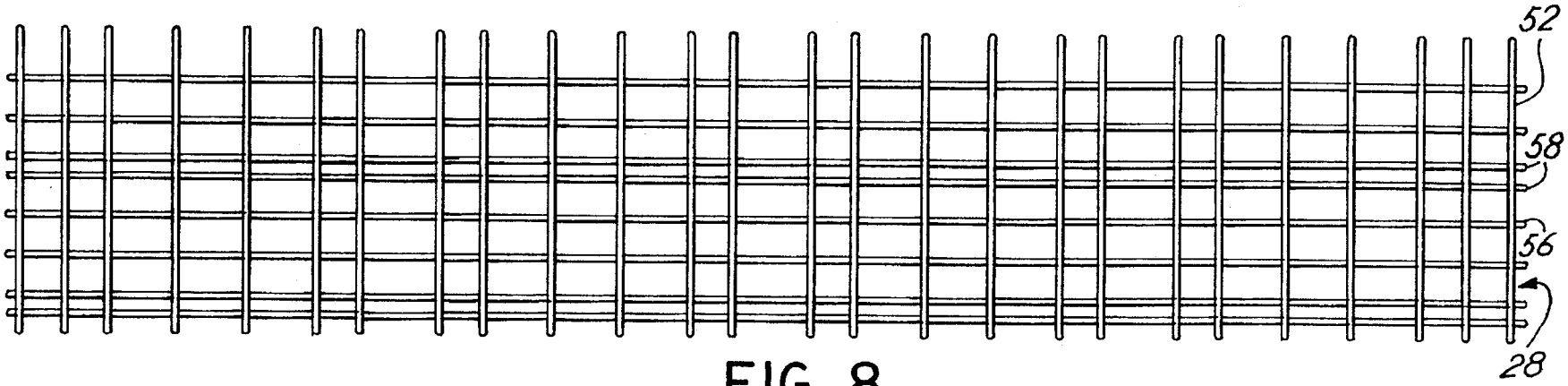
FIG. 8 is a front elevation of the panel of FIG. 7.
Figure 6:
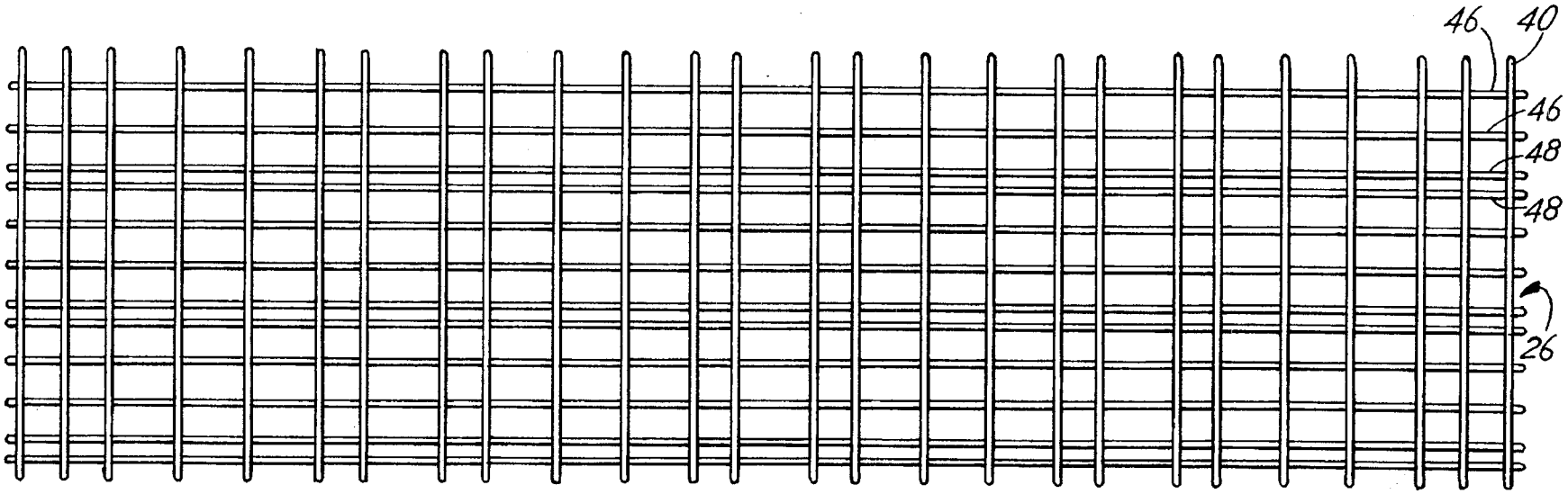
FIG. 6 is an elevation of the full size panel of FIG. 5.

FIGS. 5, 6, 7 and 8 depict the general construction of the panels 26 and 28, respectively. FIGS. 5 and 6 depict the construction of the full size panel 26. FIGS. 7 and 8 depict the general construction of the half size panel 28. First it is noted that the width of all of the panels 26 and 28 as well as the base component 24 is substantially the same. Thus, the panels 26, 28 and base components 24 can be arranged in vertical columns as depicted in FIG. 2. However, the arrangement of vertical columns is not a limiting feature of the invention though it is preferred for purposes of effecting the construction of the bulk form 10. That is, variable modular widths of panels 26, 28 may be utilized to create a mosaic of panel sizes for the front face 14. The panels 26 and 28 are related in that the panel 28 is generally one half the height of the panel 26. This modular relationship of the ratio of heights may be varied in accord with construction requirements. The preferred embodiment implements the ratio described. Typically the full size panel 26 has a height on the order of forty (40) inches. The half size panel will thus have a height on the order of twenty (20) inches.

The full size panel 26 includes vertical reinforcing bar stringers 40 which include a vertical straight run 42 and a curved or top hook end 44. Incorporation of a top end hook 44 is optional. Horizontal cross bars 46 are attached to the stringer 40 to form the pattern as depicted in FIG. 5. Horizontal reinforcing bars 48 are arranged in pairs and are also attached to the stringers 40 including attachment along the base of panel 26. The reinforcing bars 48 are closely aligned having on the order of one (1) inch spacing from one another. All of the bars 40, 46 and 48 are welded together to form the pattern of the panel 26 as depicted in FIG. 6.

Referring to FIGS. 7 and 8, the half size panel 28 also includes vertical stringers 50 having a vertical run 52 and a top hooked end 54. Hooked end 54 is optional. The vertical run 52 is approximately one half the length of run 42 associated with panel 26. The hook 54 however is substantially the same size and configuration as the hook 44. Cross bars 56 are arranged in a horizontal array and spaced one from one another. Reinforcing cross bars 58 spaced approximately one (1) inch from one another are provided at intervals on the face of the panel 28 and at the base of panel 28. FIG. 8 depicts the pattern or array which is created by virtue of the arrangement of various cross bars 56, 58 and stringers 50.

Stabilizing Members

Figure 9:
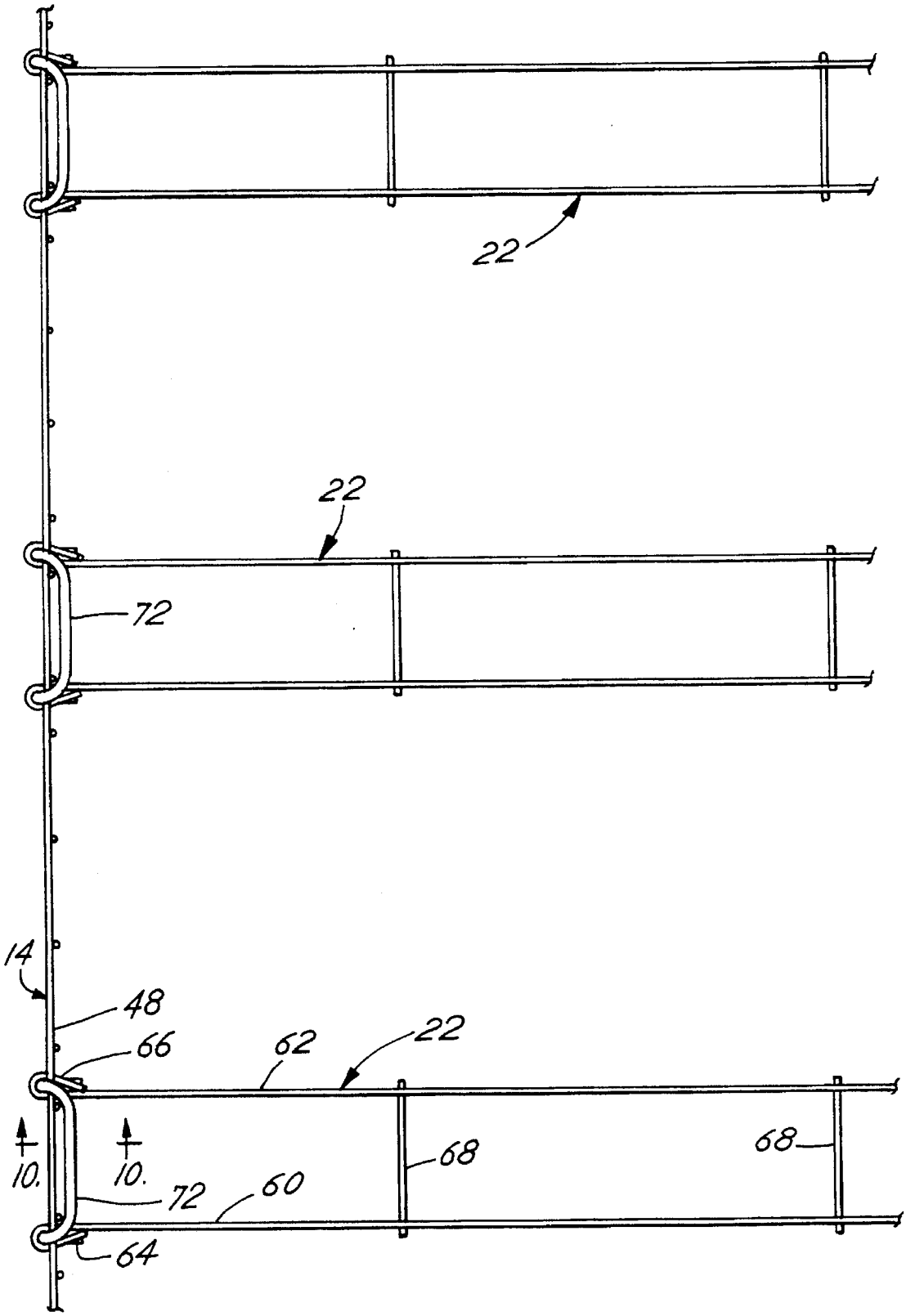
FIG. 9 is a plan view of a series of stabilizing members projecting into an earthen work bulk form and attached to a front wire mesh panel by means of a handle bar connector.

FIGS. 9, 10, 11, 12 and 13 illustrate the stabilizing members and various aspects of their incorporation in the earthen work bulk form 10. Referring first to FIG. 9 there is illustrated a preferred embodiment of a stabilizing member 22. The stabilizing member includes a first tension arm 60, a generally parallel second tension arm 62 both of which are formed from a reinforcing bar having a looped end 64 for tension arm 60 and end 66 for tension arm 62. In this preferred embodiment of the stabilizing member 22, the tension arms 60, 62 extend outwardly as a continuation of the same reinforcing bar and are interconnected by means of cross members or cross bars 68 at spaced intervals. The cross members 68 are for the purpose of maintaining the arms 62 and 60 in a parallel array. Additionally, the cross members 68 are preferably arranged so that their presence is maintained in the so-called resistive range or area of the earthen work bulk form 10, wherein the bulk form 10 is constructed in accord with the mechanically stabilized earth technology of the type referenced in the Vidal patents referenced herein.

Typically, the stabilizing members 22 extend from the front face 14 of the bulk form 10 to the back side boundary 16. However, a number of the stabilizing members 22 may be foreshortened and still included in the construction. Foreshortened stabilizing members 22 are useful for engaging the front face panels 26 and 28 and insuring that the panels 26, 28 are retained tightly in the bulk form 10 so as to maintain the panels 26, 28 flat and thus provide a flat front facing 14.

Figure 10:
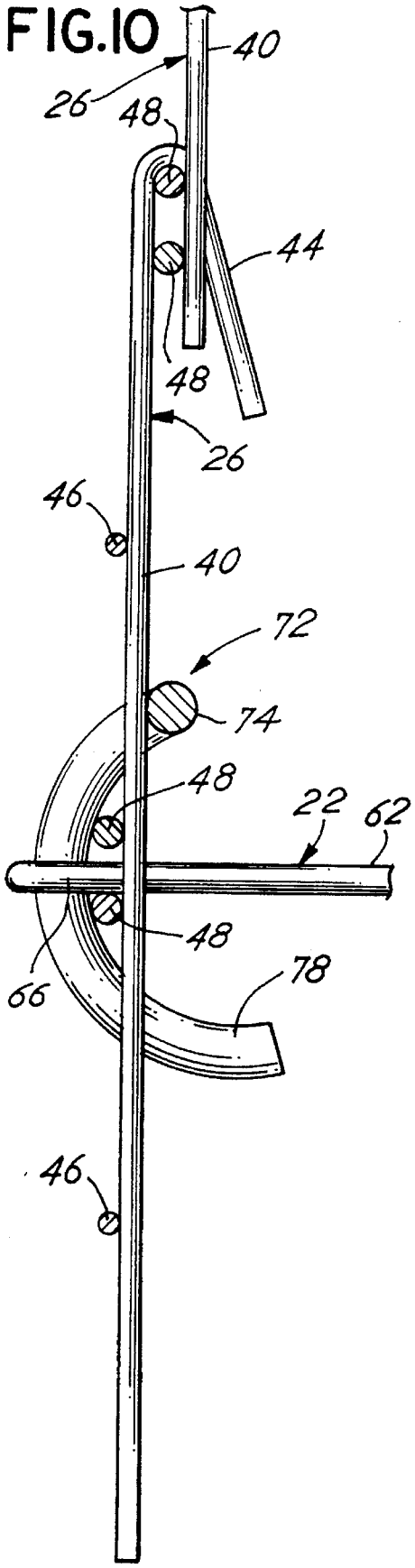
FIG. 10 is a cross-sectional view of the connector of FIG. 9 taken along the line 10—10.
Figure 10A:
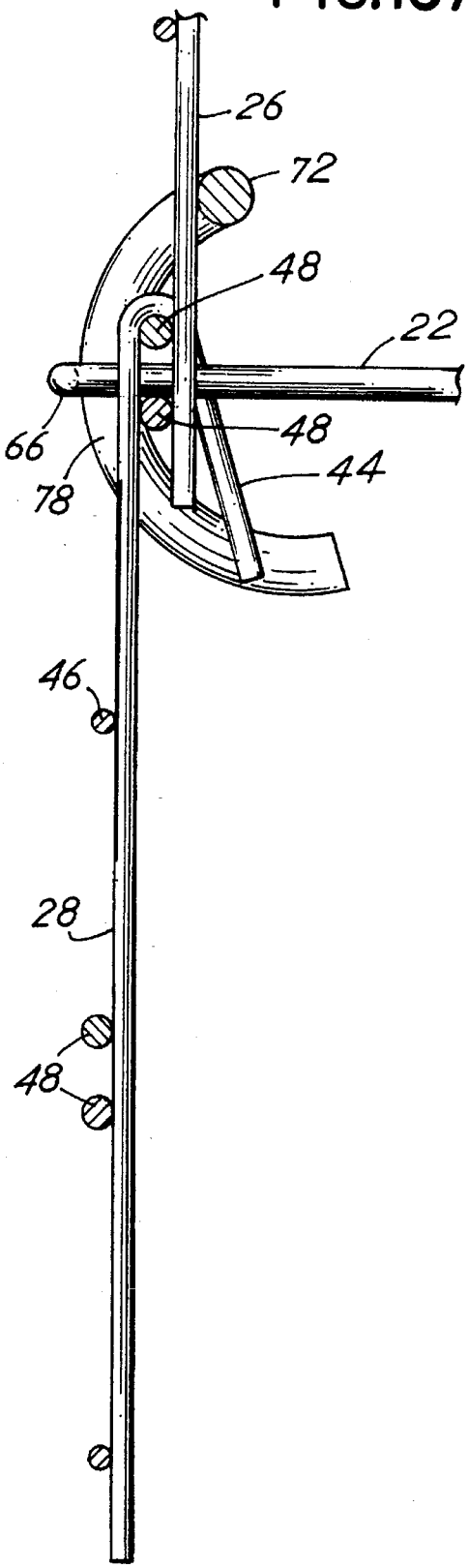
FIG. 10A is a cross-sectional view of the connector of the type depicted in FIG. 9 positioned for coupling at the junction of vertically adjacent facing panels.
Figure 12:
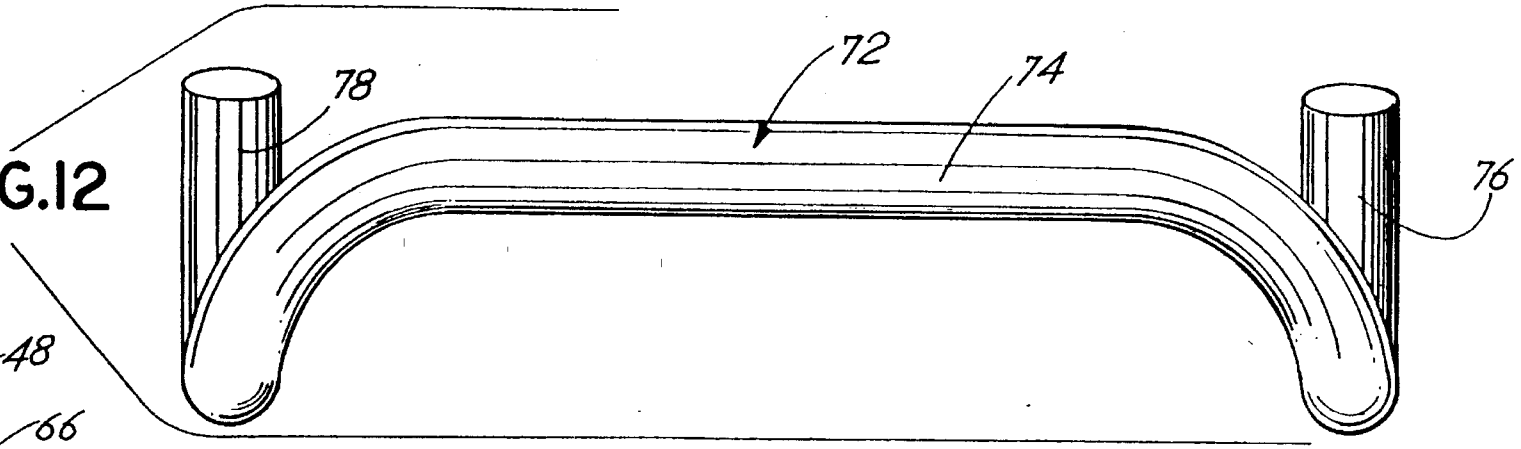
FIG. 12 is an enlarged plan view of the handle bar connector used to connect stabilizing members to the front wire mesh panels.

The stabilizing members 22 cooperatively engage the panel members 26 or 28 by means of a handle bar connector as depicted in FIG. 12. The handle bar connector 72 includes transverse run 74 which when included in the bulk form 10 is arranged generally parallel to the front face 14 and inside the face 14 within the bulk form 10. Hooked ends 76 and 78 connect with the transverse run 74. The hooked ends 76 and 78 cooperate respectively with the loops 64 and 66 of the stabilizing member 22 as depicted in FIG. 9 as well as FIGS. 10 and 10A. That is, referring to FIGS. 10 and 10A, the stabilizing member 22 and, more particularly, the loop 66 of the tension arm 62 fits through a slit in fabric 30 and the front face 14 and, more particularly, between the reinforcing cross bars 48 that are welded or attached to the vertical stringers 40. The hooked end 78 of the handle bar connector 72 then is guided from the back side of the front face 14 over the reinforcing bars 48 and through the loop 66. FIG. 10 depicts the described connection in mid panel. FIG. 10A depicts the described connection at the junction of vertically adjacent panels.

Figure 11:
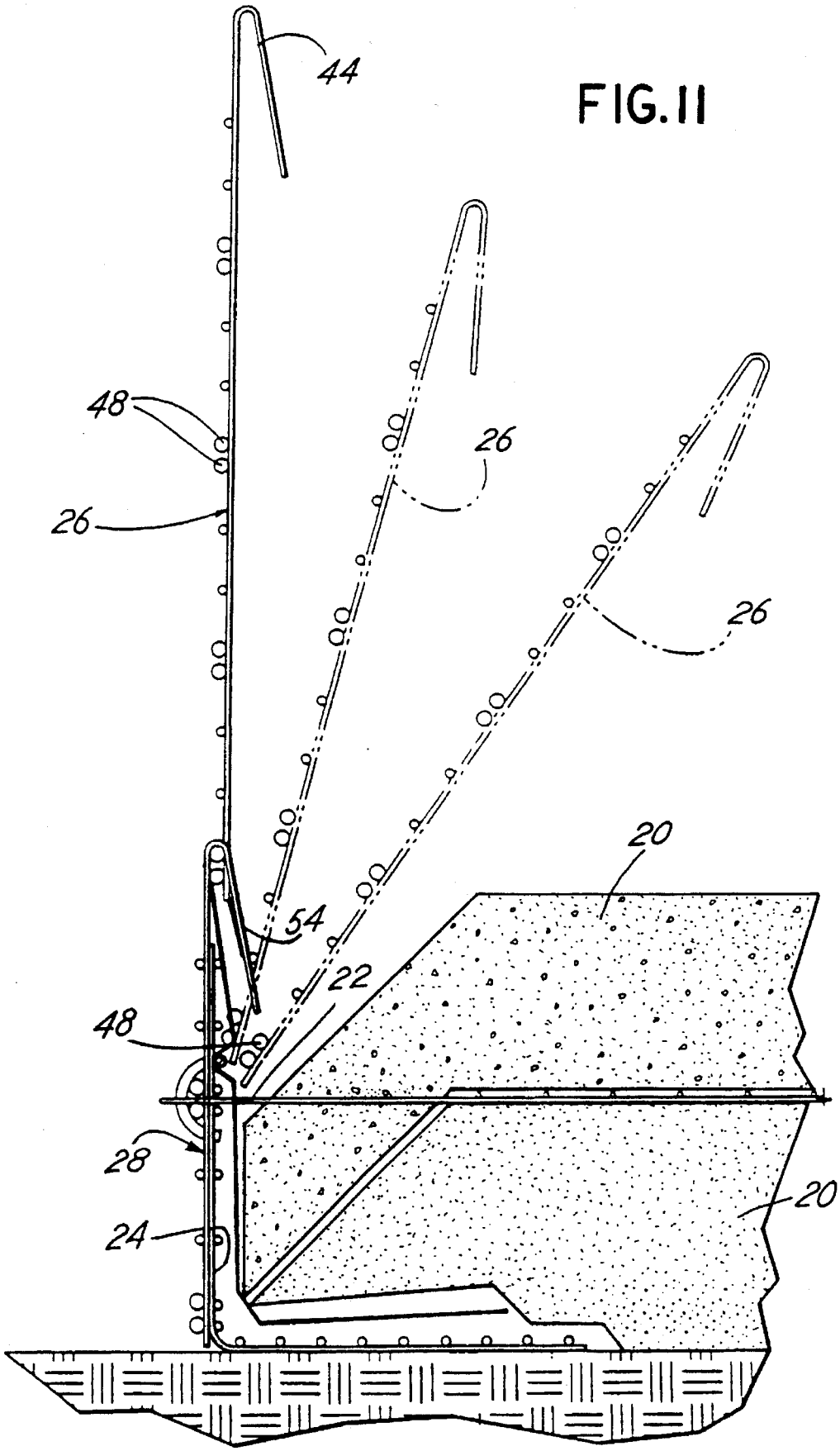
FIG. 11 is an enlarged side cross-sectional view of the interconnection of vertically adjacent front facing panels.

The tension arm 62 is generally in tension and tends to retain the stabilizing member 22 tightly against the front face 14 or, in other words, against the panel 26. The handle bar connector 72 insures that the stabilizing member 22 and the front panel 26 will remain connected together. FIG. 11 depicts the manner in which the stabilizing member 22 is oriented with respect to the front face 14 during construction. The stabilizing member 22 extends substantially horizontally into the bulk form 10 and retains the front face 14 appropriately vertically aligned.

Method of Construction

Figure 14:
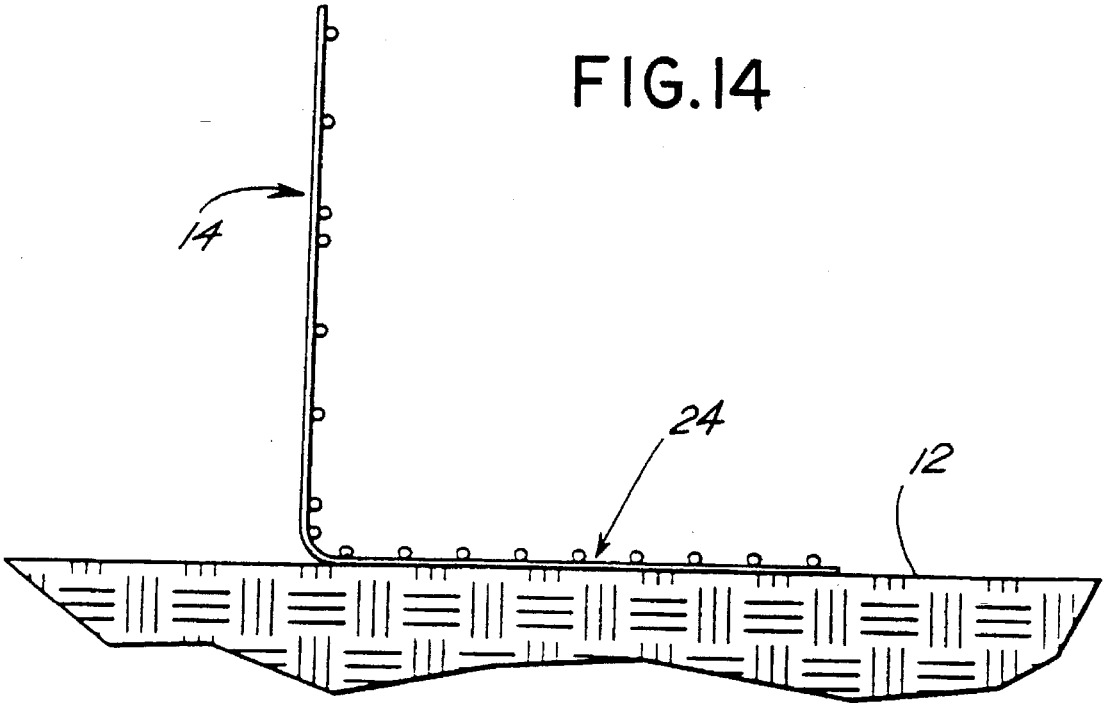
FIGS. 14 through 23 illustrate in side sectional views the sequential steps of the construction of an earthen work bulk form utilizing the method of the invention.

FIGS. 14 through 23 illustrate the sequential steps in the construction of a typical earthen work bulk form using the described components of the invention. Referring first to FIG. 14, which is a side cross sectional view of the base component 24, initially the datum plane 12 for the earthen work is established. Typically the datum plane 12 is a generally planar surface which is created by appropriate grading and compacting of soil. The datum plane 12 defines a planar surface which extends from the region of the front face 14 of the earthen work rearwardly to the back side boundary 16. Typically the base components 24 are arrayed along a line which is desired for the front wall. Additionally the base components 24 are laterally connected one to the other by means of steel rings or other fastening means which connect the base components 24 particularly along the vertical portion 27 of the stringers 36. The horizontal run 25 may also be interconnected if the wall is to be a straight wall. However, if the wall is curved in a concave fashion the stringers 36 which are horizontal cannot be connected except by some linking means or members. Such connection is not required however.

Figure 15A:
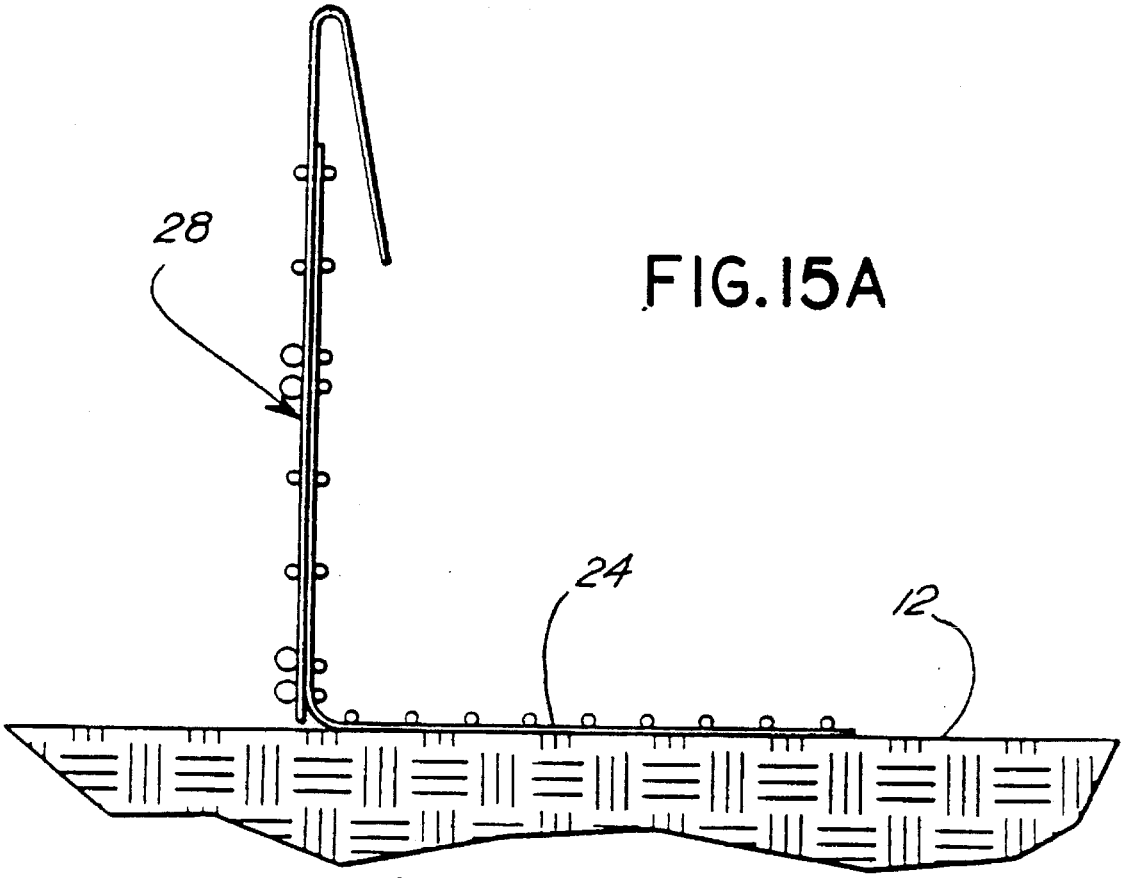
Figure 15:
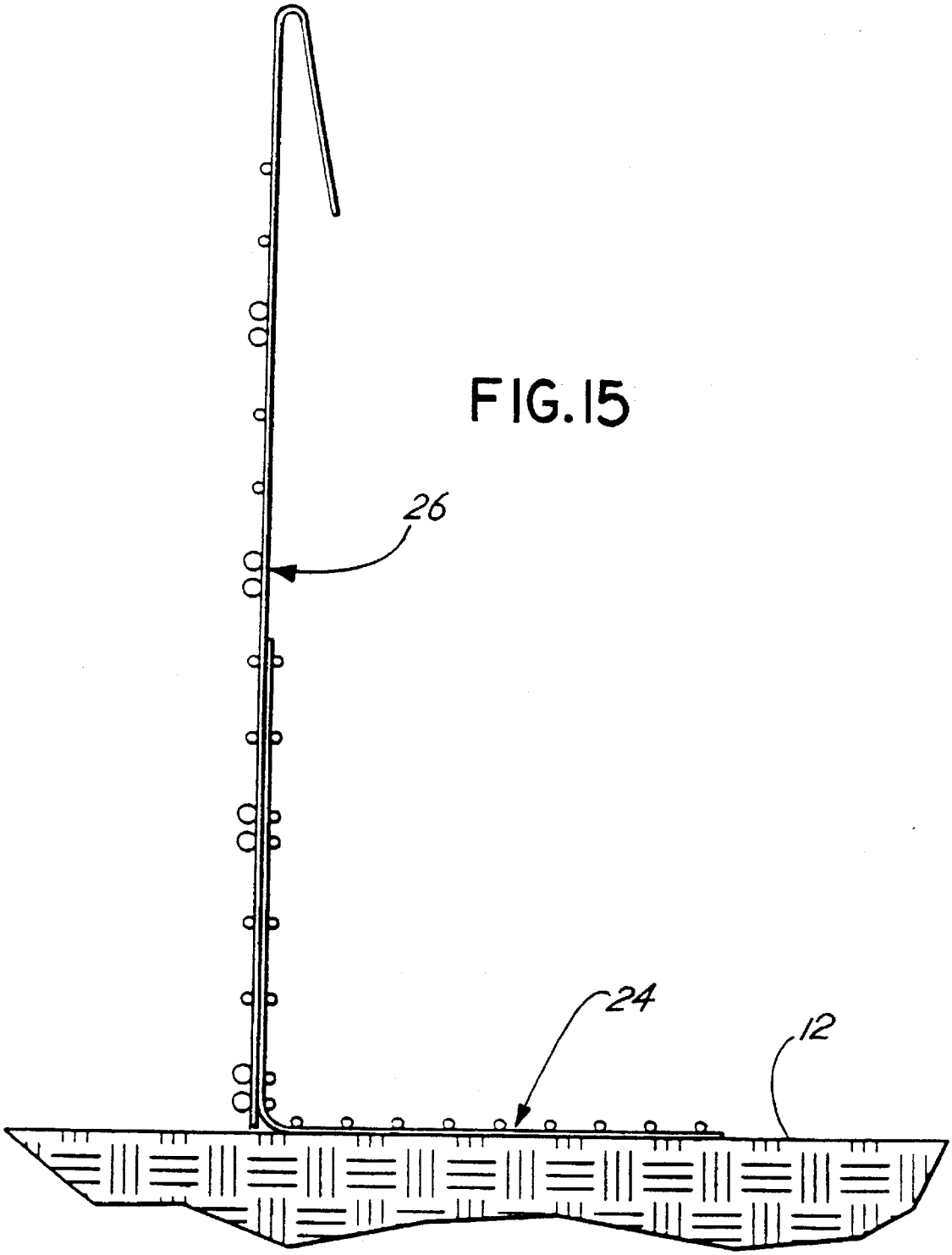

As the next step in the construction, a full size panel 26, illustrated in FIG. 15 or a half size panel 28 as illustrated in FIG. 15A is attached to the base components 24. Alternating full and half size panels 26 and 28 are attached to adjacent base components 24 so that the height of the panels 26 and 28 varies along the front face 14. Typically, the vertical panels 26 and 28 are initially attached to the vertical run 27 of the base component 24 by means of rings or the like or other connecting means.

Figure 16:
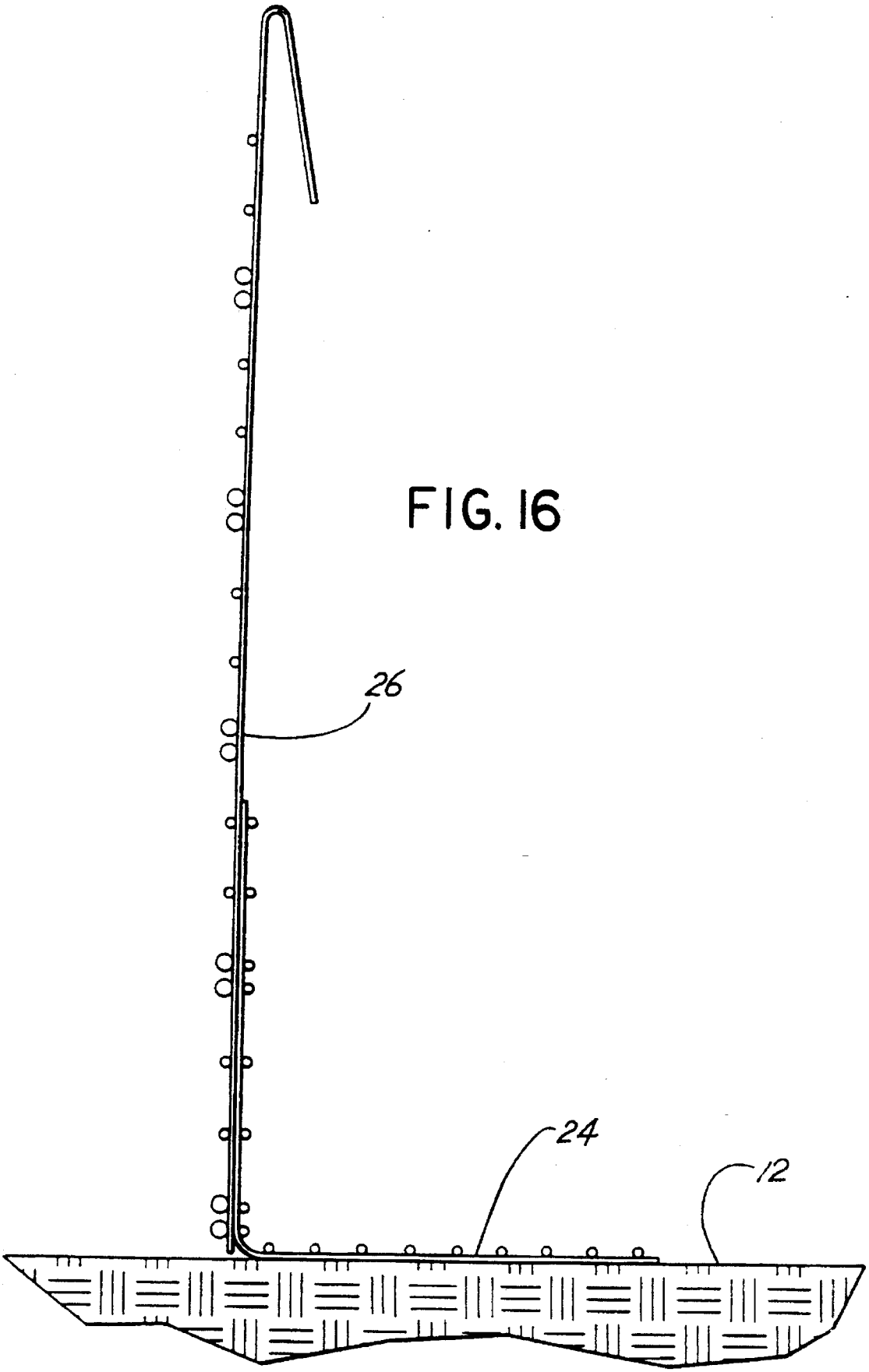
Figure 16A:
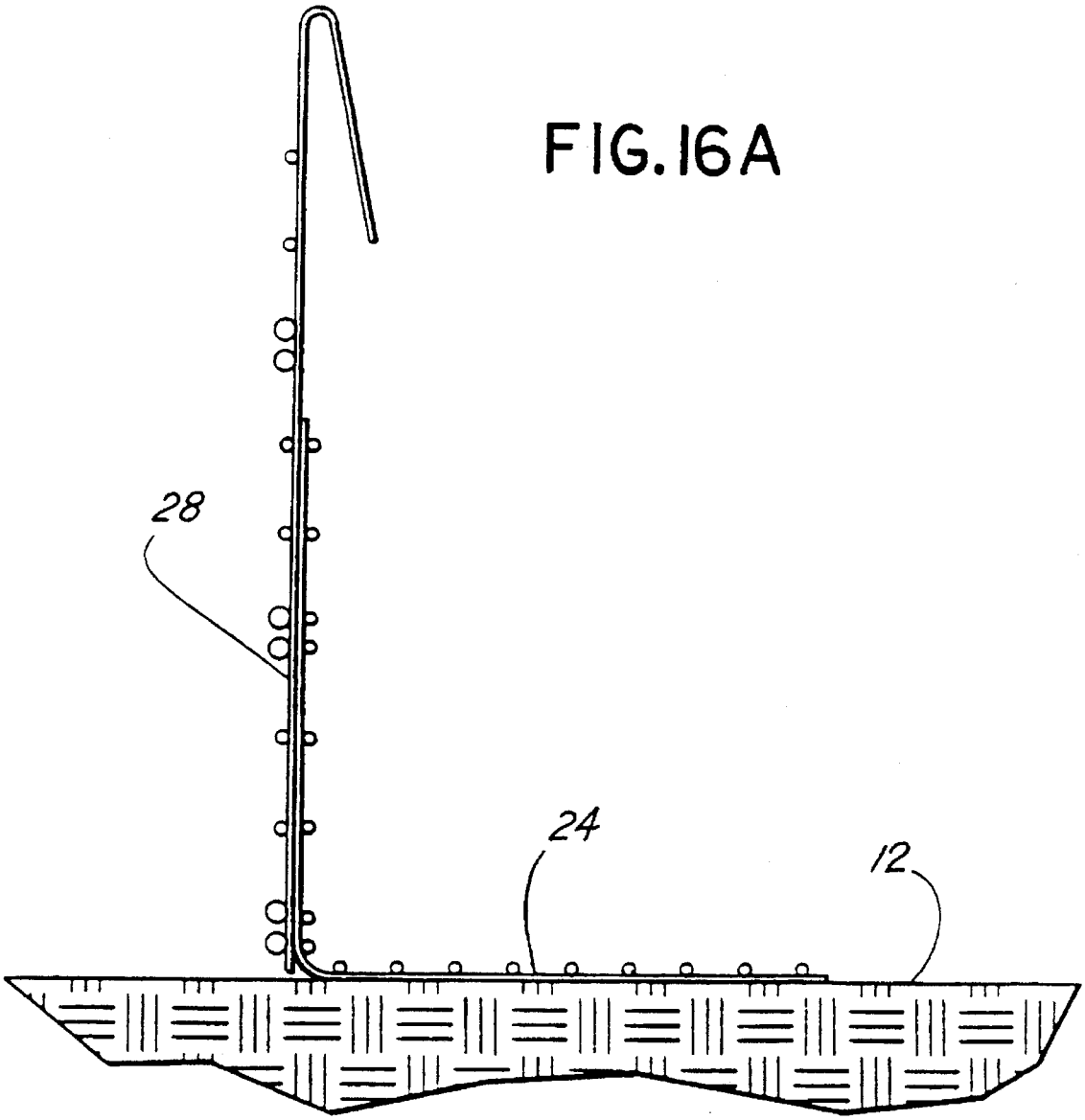

FIGS. 16 and 16A illustrate the utilization of panels 26 and 28 of different heights which are still related in a modular fashion, one to the other, in that their vertical heights are related. The panels of FIGS. 16 and 16A are larger panels than those of FIGS. 15 and 15A. FIGS. 16 and 16A are thus included to demonstrate that panels 26 and 28 of various modular heights may be used in the practice of the invention.

Figure 17:
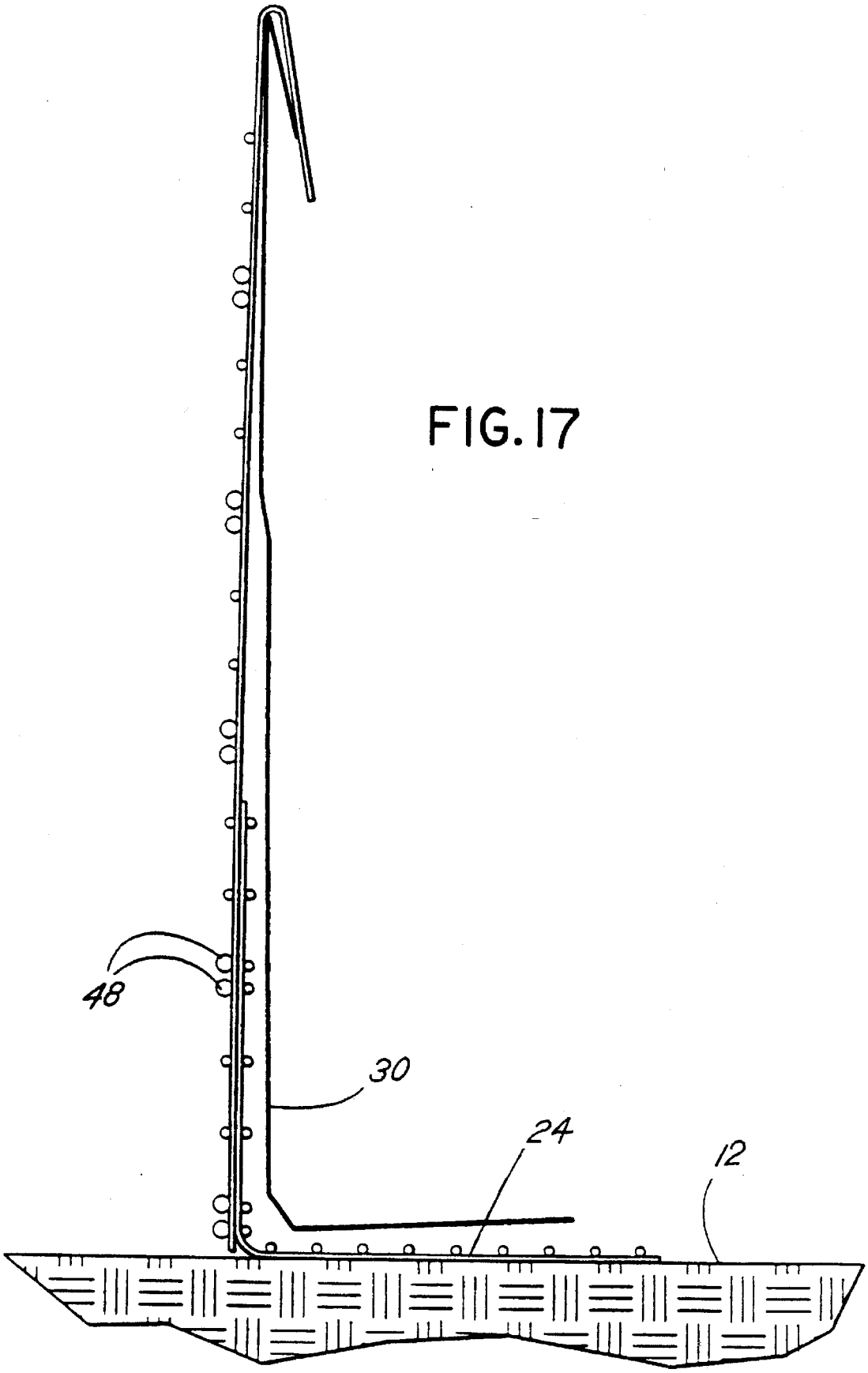

The next step in the construction process or method is to insert a filter cloth 30 as an inside liner with respect to the panels 26 and/or 28. This is illustrated in FIG. 17. Slits must be cut through the filter cloth 30 adjacent the cross bars, such as cross bars 48.

Figure 18:
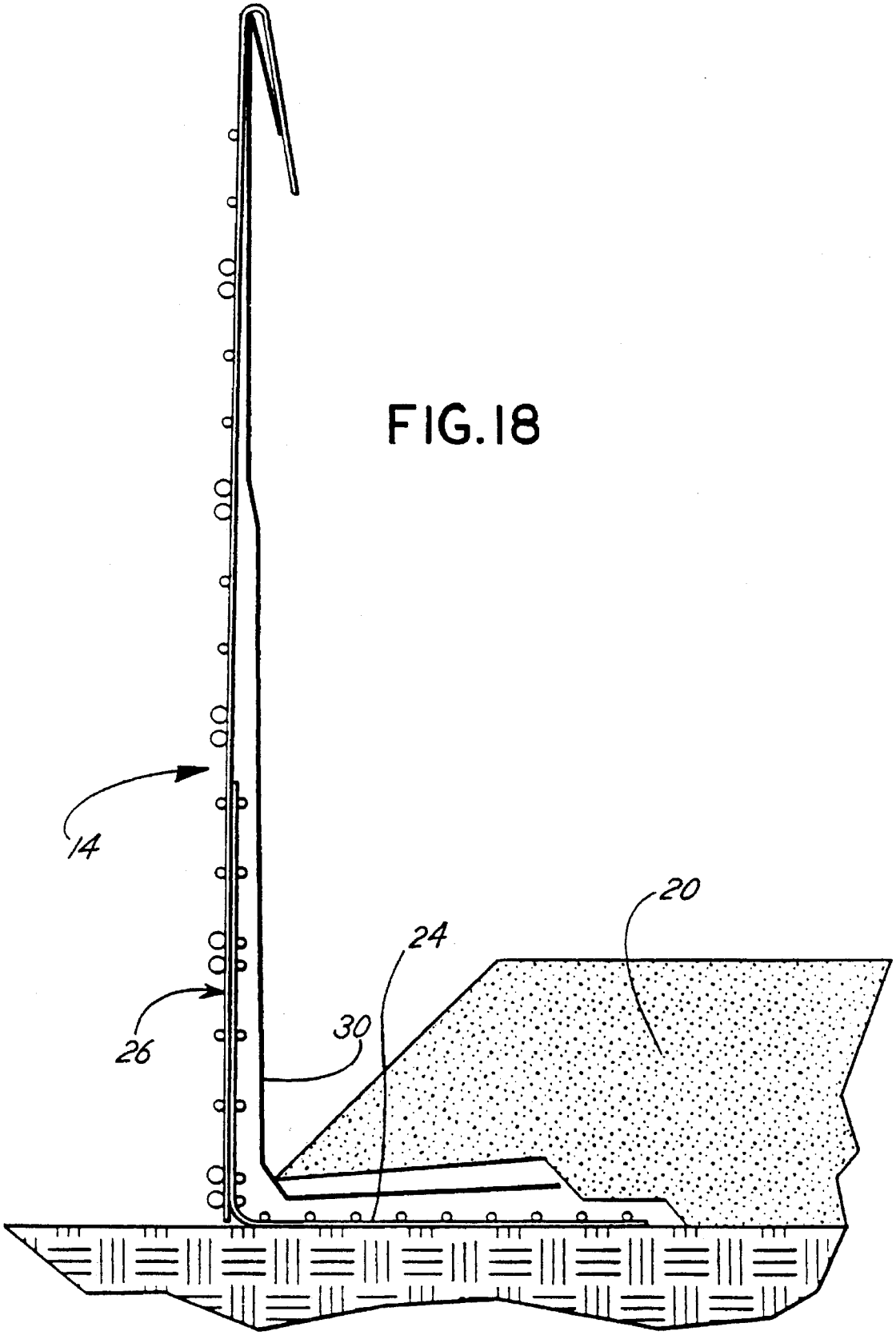

Referring next to FIG. 18, a first layer of granular backfill or particulate 20, which covers base component 24, as well as the filter cloth 30 which has a horizontal run over the base component 24, is placed down and compacted. The particulate 20 is angled down toward the front face 14 as depicted in cross section.

Figure 19:
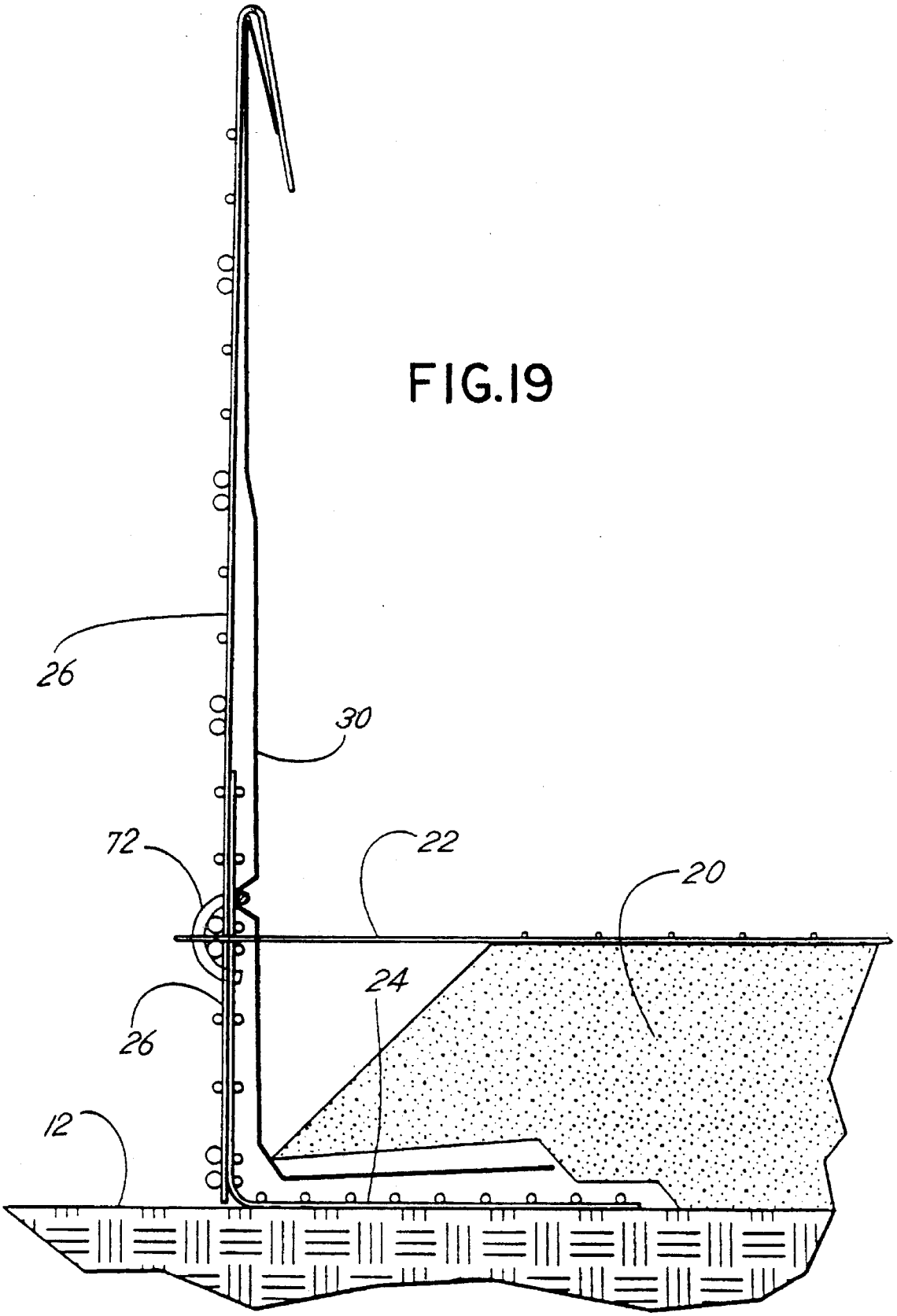

Referring to FIG. 19, a stabilizing member 22 or a series of stabilizing members 22 are positioned on the particulate 20, and the hooks or loops 64 and 66 are inserted between the cross bars 48 and, of course, the slits in the filter cloth 30. The handle bar connector 72 is then inserted through the loops 64 and 66 in the manner depicted in FIGS. 9 and 10. The stabilizing members 22 will be pulled inwardly toward the earthen work bulk form 10 to appropriately vertically align the panels 26 or 28, as the case may be.

Figure 20:
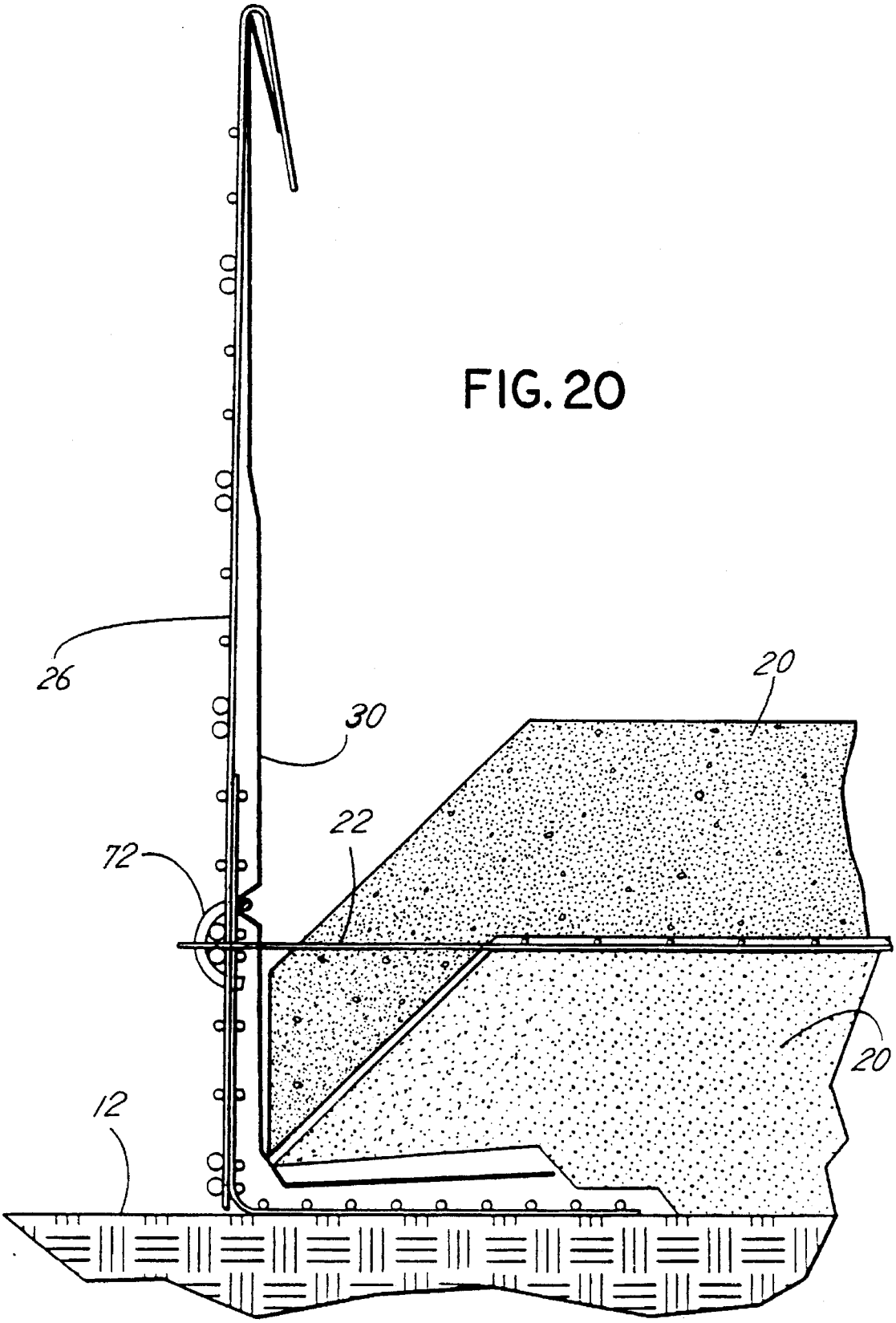
Figure 20A:
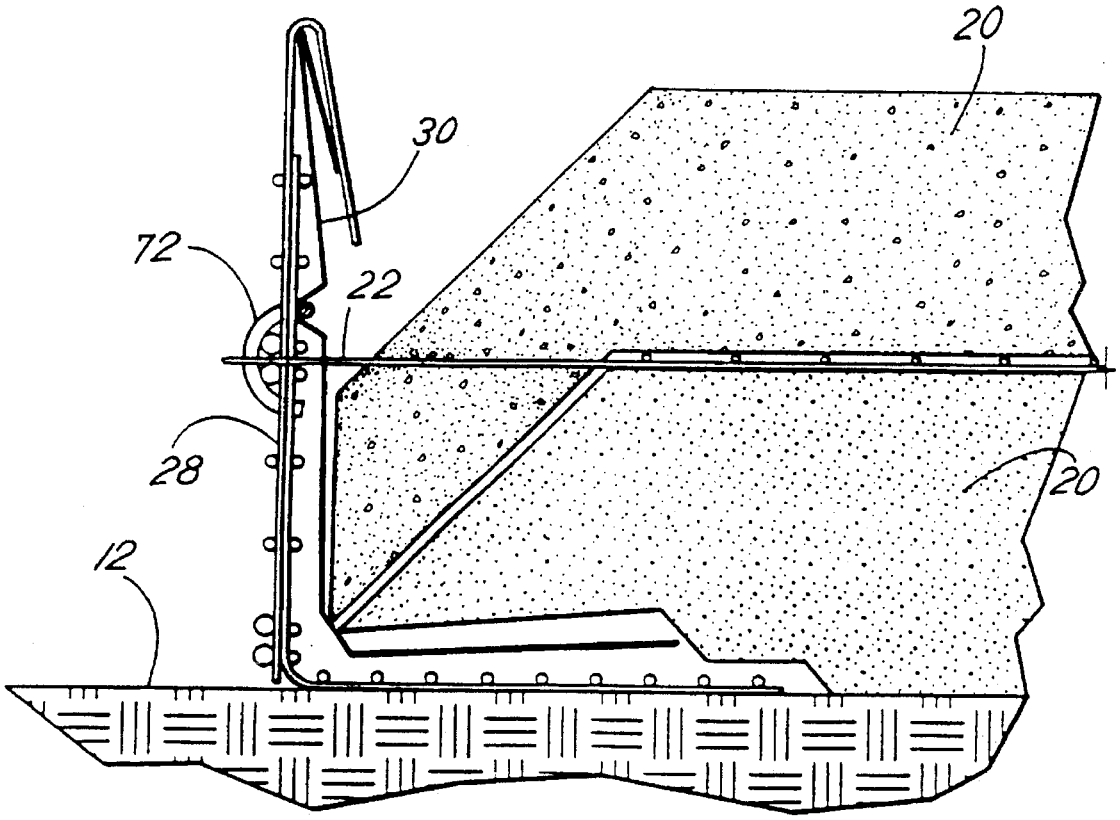

Next referring to FIGS. 20 and 20A, there is illustrated the subsequent step wherein a further course or layer of granular fill or particulate 20 is added over the stabilizing member 22. FIG. 20 illustrates this addition with respect to the full size panel 26. FIG. 20A illustrates this step with respect to a half size panel. Note that in this instance the particulate material 20 fills in the area from the base of the earthen work up to at least the horizontal line established by the stabilizing member 22.

Figure 21:
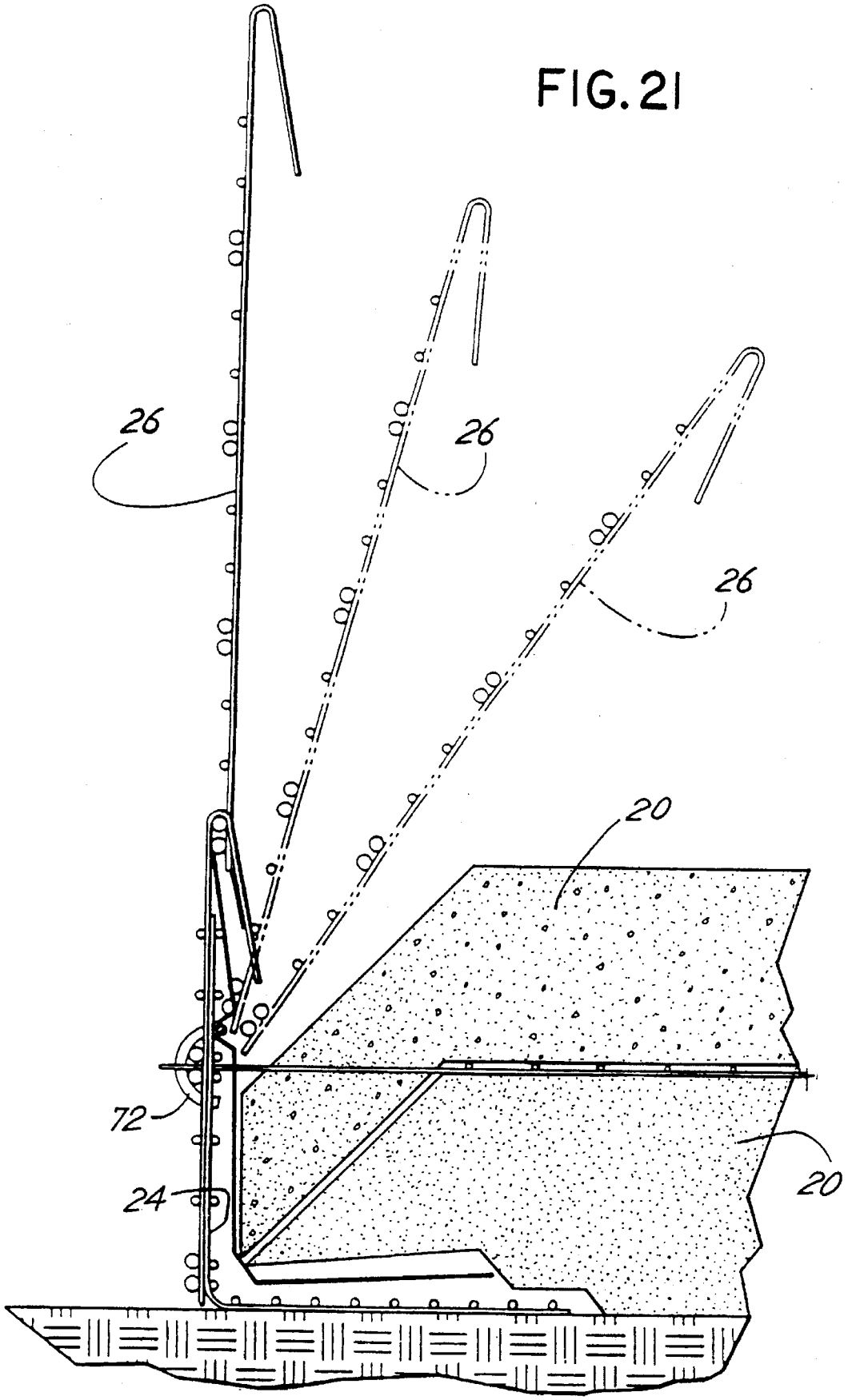

FIG. 21 illustrates the next step in the process of building layer upon layer of compacted granular material 20 into which stabilizing members 22 are projected from the front face 14 of the mesh. In this next step, for purposes of illustration, a one half size panel 28 has been positioned in combination with the base component 24. Thus, it is necessary to place a full size panel 26 on top of the one half size panel 28. This is done by positioning the full size panel 26, as illustrated in phantom, so that the lower cross bars 48 will fit under the hook 54. Then the panel 26 is raised so that the cross bars 48 fit into the bend defined by the hook 54. The panels 26 adjacent the panel 26 illustrated in FIG. 1 will extend upwardly for one half of the height of the panel 26. Thus, the adjacent panels 26 may be connected to the panel 26 illustrated in FIG. 21 to support the panel 26 in the solid position illustrated in FIG. 21. This interconnection is effected by means of insertion of the loops 64 and 66 through the enlarged cross bars 48 of adjacent panel members 26. This linking or crossing over of the stabilizing members 22 to engage horizontally adjacent panel members 26 is illustrated in FIG. 2 by the cross connections numbered 80. These cross connections 80 represent the engagement of a stabilizing member 22 with horizontally adjacent panels 26 and/or 28.

During any of these constructional steps, it may be desirable to use other fasteners to connect the various panels 24, 26 and 28. Nonetheless, because generally flat wire rod panels 26, 28 are being used rather than L-shaped panels and generally flat stabilizing members 22 are used in conjunction therewith, the ease of assembly of the bulk form 10 is enhanced and may proceed without utilization of large equipment for moving the various component parts.

Figure 22:
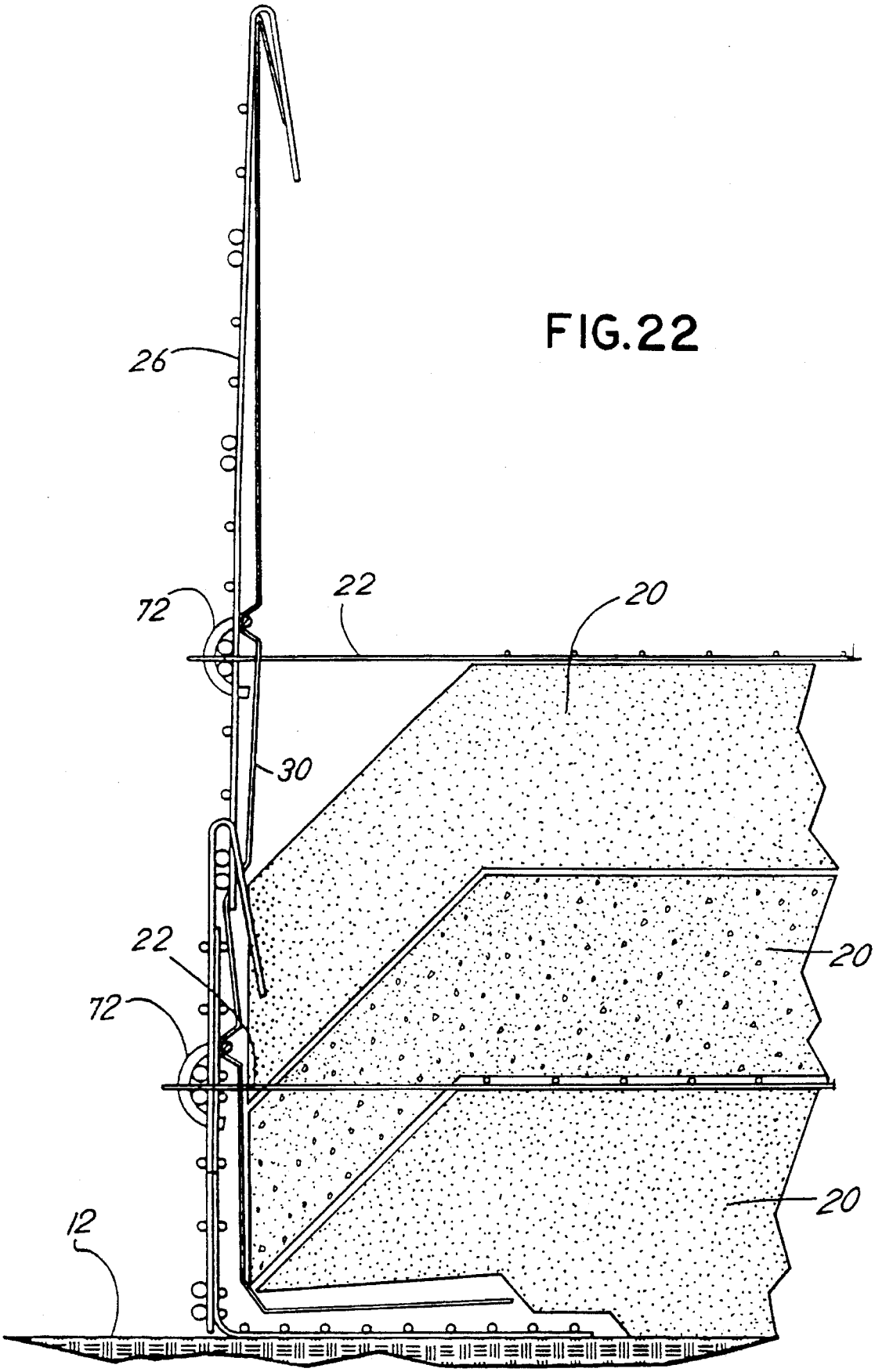

Referring next to FIG. 22, there is illustrated the addition of a subsequent layer of particulate material 20 as well as the addition of a further stabilizing member 22 in combination with the additional front panel 26. Note, that after the panel 26 has been added, an appropriate filter cloth 30 or additional screening on the backside of the panel 26 is provided.

Figure 13:
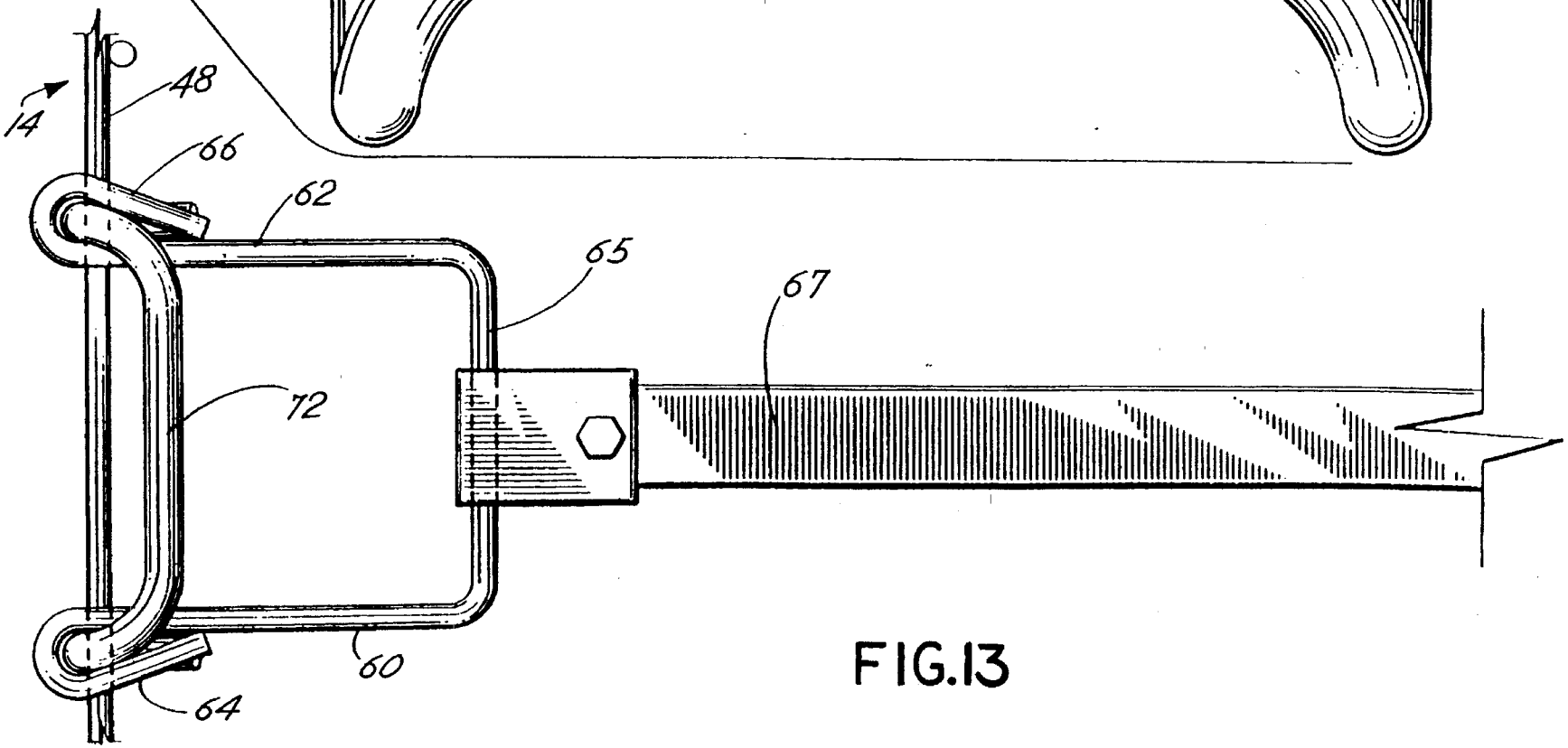
FIG. 13 is a plan view of a first alternative construction for a stabilizing member.
Figure 13A:
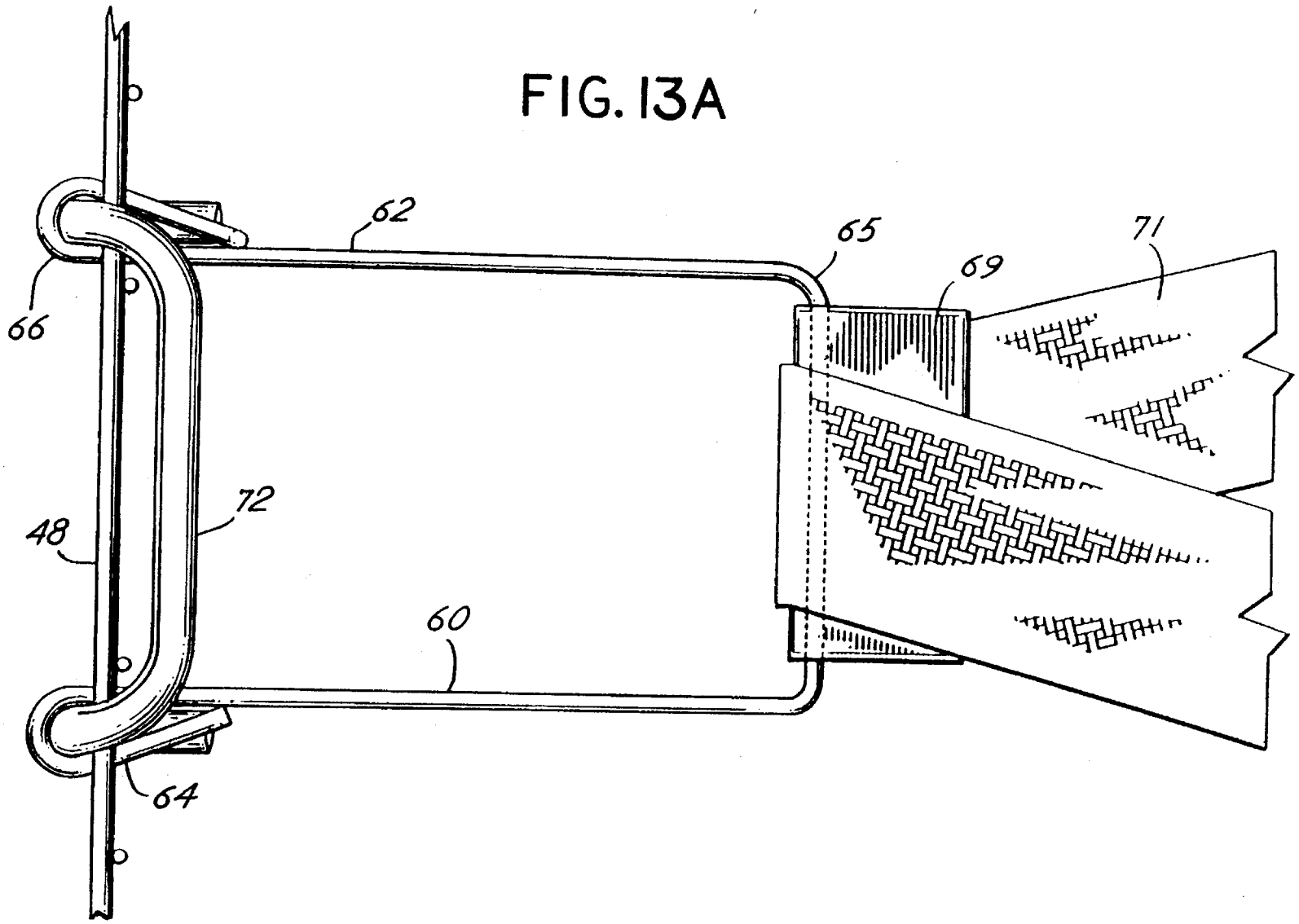
FIG. 13A is a plan view of as second alternative construction for a stabilizing member.
Figure 23:
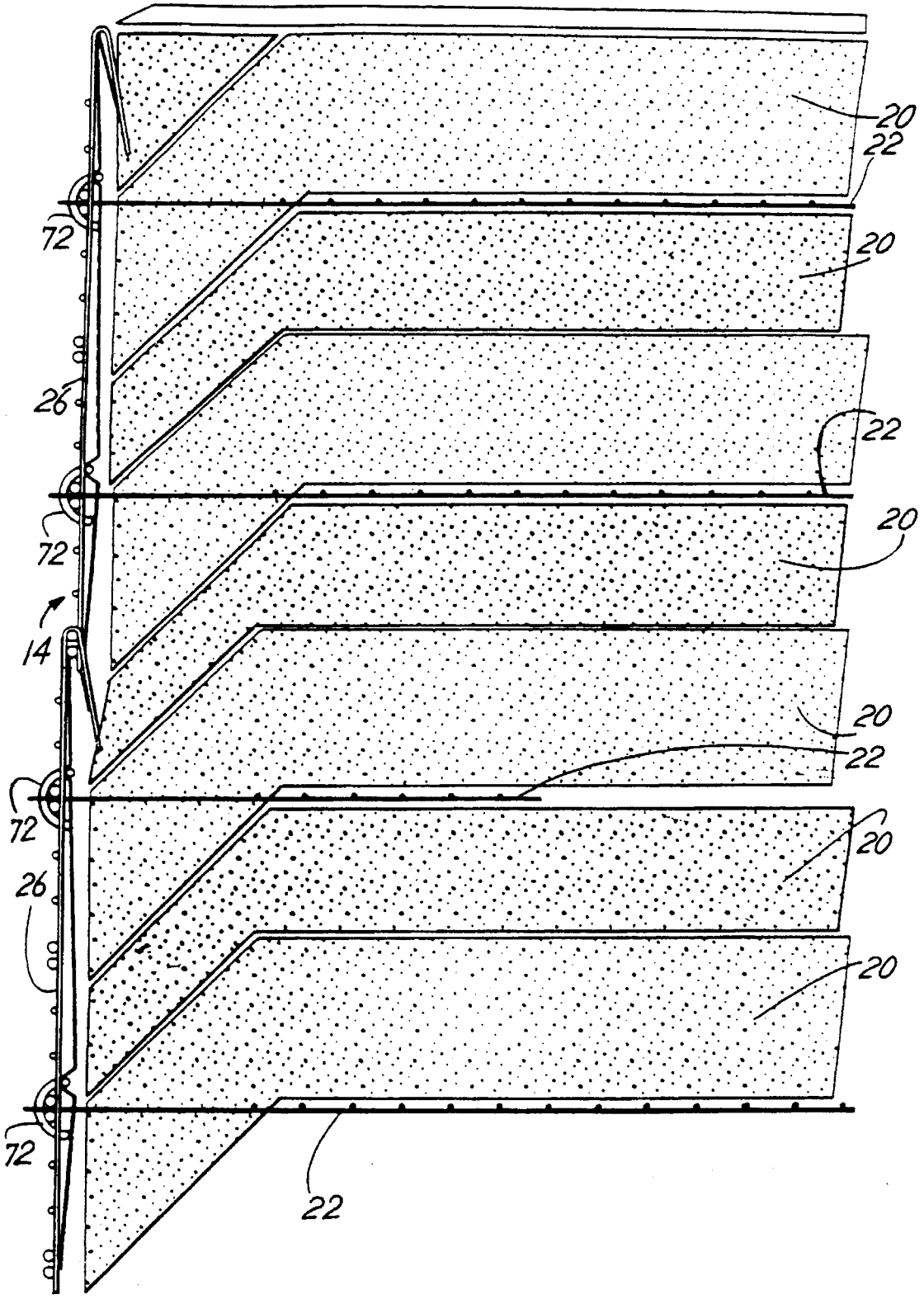

FIG. 23 illustrates a further layering of various courses of particulate materials 20 and stabilizing members 22. It is to be noted that the stabilizing members 22 do not need to be included in combination with each and every position of the cross bars 48. Further, the stabilizing members 22 may be arrayed so that the length of a stabilizing member 22 which extends into the earthen work bulk form 10 may be varied from layer to layer or at each layer depending upon design considerations. Note also by reference to FIGS. 13 and 13A, that alternative stabilizing members 22 may be utilized. That is, referring to FIGS. 13 and 13A, the tension arms 60 and 62 may be interconnected by a cross member 65. Attached to that cross member 65 may be other types of stabilizing elements such as a rigid bar or strap 67 in FIG. 13, or a flexible strap 71 over a generally curved plate 69 in FIG. 13A, or anchoring means or other means which will permit the construction of the bulk form 10.

Cast in Place Facing Embodiment

Figure 24:
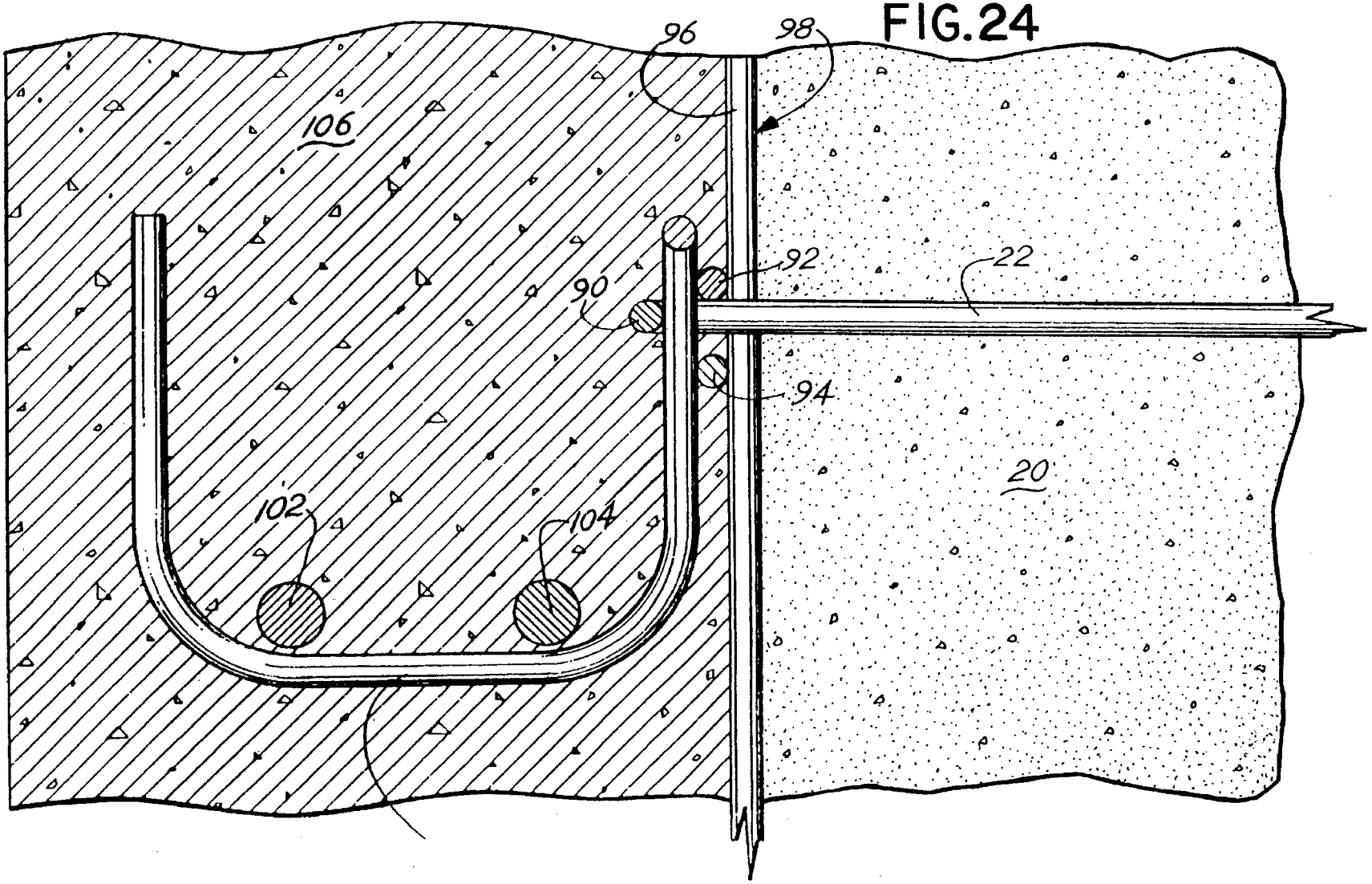
FIG. 24 is a side cross-sectional view of an alternative handle bar connector in a wall construction wherein stabilizing members are attached to facing panels and the connector simultaneously projects from the facing panels to define reinforcing elements in a cast in place concrete facing over the wire mesh facing panels.

Referring next to FIGS. 24 through 27 there is depicted an embodiment of the invention wherein the earthen work bulk form 10 is constructed in combination with a cast in place front wall. That is, as shown in FIG. 24, stabilizing members 22, generally of the type previously described, are retained within particulate material 20 and include loop ends 90 which fit through or between horizontal reinforcing bars 92 and 94 welded to or attached to vertical reinforcing bars 96 of a front facing panel 98. A special handle bar connector 100, which is depicted in greater detail in FIGS. 25 through 27, fits through the loop ends 90 of the stabilizing elements 22 thereby retaining the stabilizing elements 22 in place relative to the facing panel 98. The handle bar connector 100 also projects outwardly from the facing panel 98. It is formed so as to support horizontal reinforcing bars 102 and 104.

An aggregate, such as concrete 106, is then cast in place against the front panel members 98. The aggregate encapsulates the handle bar connector 100 as well as the reinforcing bars 102 and 104. In this manner, the earthen work bulk form 10 of the invention which includes a wire mesh facing can also include a cast in place wall of concrete 106, for example.

Figure 26:
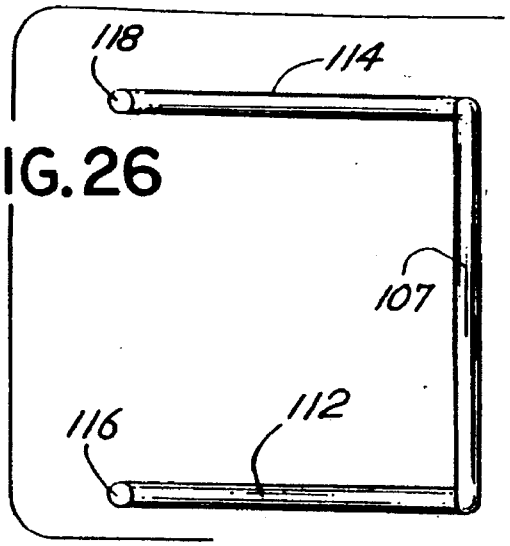
FIG. 26 is a top plan view of the connector of FIG. 25.
Figure 27:
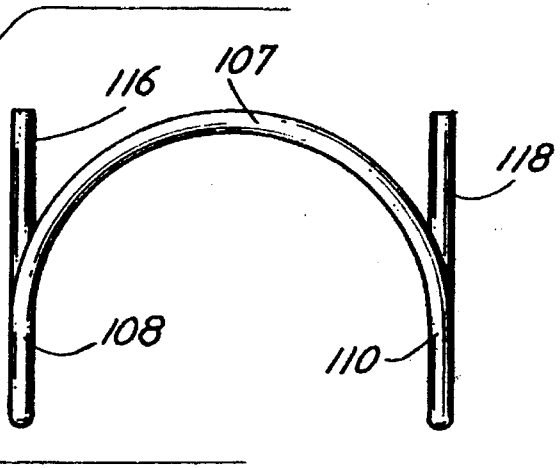
FIG. 27 is a side view of the connector of FIG. 25.
Figure 25:
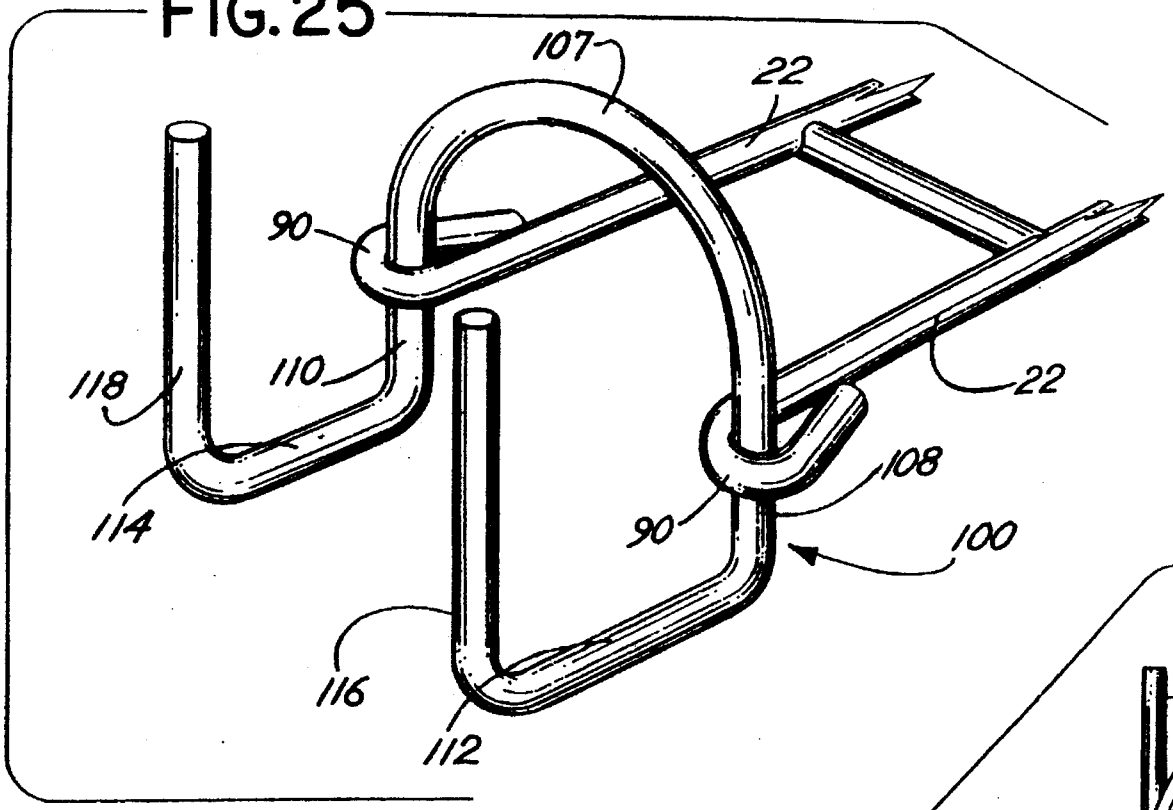
FIG. 25 is an isometric view of the connector depicted in the wall construction of FIG. 24.

The handle bar connector 100 in this embodiment serves a plurality of functions including retention of stabilizing elements 22, locking of the stabilizing elements 22 with respect to the front panel facing 98, support of additional reinforcing members 102 and 104, and reinforcement of the cast in place wall 106. Referring next to FIG. 25, there is depicted in greater detail the handle bar connector 100 shown in FIG. 24. The handle bar connector 100 includes a connecting crown 107, spaced vertically depending legs 108 and 110 joined by the crown 107, outwardly extending spaced horizontal runs 112 and 114 and upwardly extending vertical terminal runs 116 and 118. The vertical runs 108 and 110 fit through the loop ends 90 of tensile members 22. This is accomplished by initially threading or inserting the terminal runs 116 and 118 through the loops 90 and then reorienting the connector 100 to the position illustrated in FIGS. 24 and 25. Note that the crown 107 coacts with the ends of the loops 90 to space the tensile members 22 an appropriate distance and to .retain the tensile members 22 in position relative to the facing panel 98. The horizontal runs 112 and 114 serve to support reinforcing members 102 and 104 which are within the cast in place wall 106. FIGS. 26 and 27 are top and side view respectively of the handle bar connector 100 depicted in the isometric view of FIG. 25.

Alternative Features and Constructions

Typically the handle bar connector 100 is made from reinforcing bar stock. Various other handle bar connectors may be utilized for attaching two or more stabilizing elements in the manner described. The configuration of the handle bar connector 100 may thus be varied.

There are other alternative constructions and features of the invention which may be utilized. For example, the particular configuration of the wire rods or reinforcing bars which make up the separate panels 26 and 28 may be varied though the particular pattern disclosed is preferred. Importantly, the generally rectangular shape of the panels 26 and 28 is a feature of the invention which enables the construction of the means for interlocking the stabilizing members 22 with the panels 26, 28. The construction of the stabilizing members 22 may be varied significantly. Tensile members as well as anchor members and combinations thereof may constitute stabilizing members. The relative heights of the panels 26, 28 may be varied. Preferably, the panels 26, 28 should be planar in construction. The use of the base components 24 is the only part of the construction which is not generally planar. The dimensions of the base components 24 are chosen, however, to minimize the problems of storage, movement and construction in that the base components 24 are the only L-shaped component among the components used to make the bulk form 10.

Another important feature of the invention is adjustability and ease of assembly of facing panels as a result of the sliding corrections of vertically adjacent panels with respect to one another. Another important feature of the invention is the utilization of the stabilizing members 22 to not only engage the panels 26 but to interconnect adjacent panels allowing stress transfer to horizontally adjacent panels. Alternative connectors or handle bar constructions are also useful in the practice of the invention.

Figure 28:
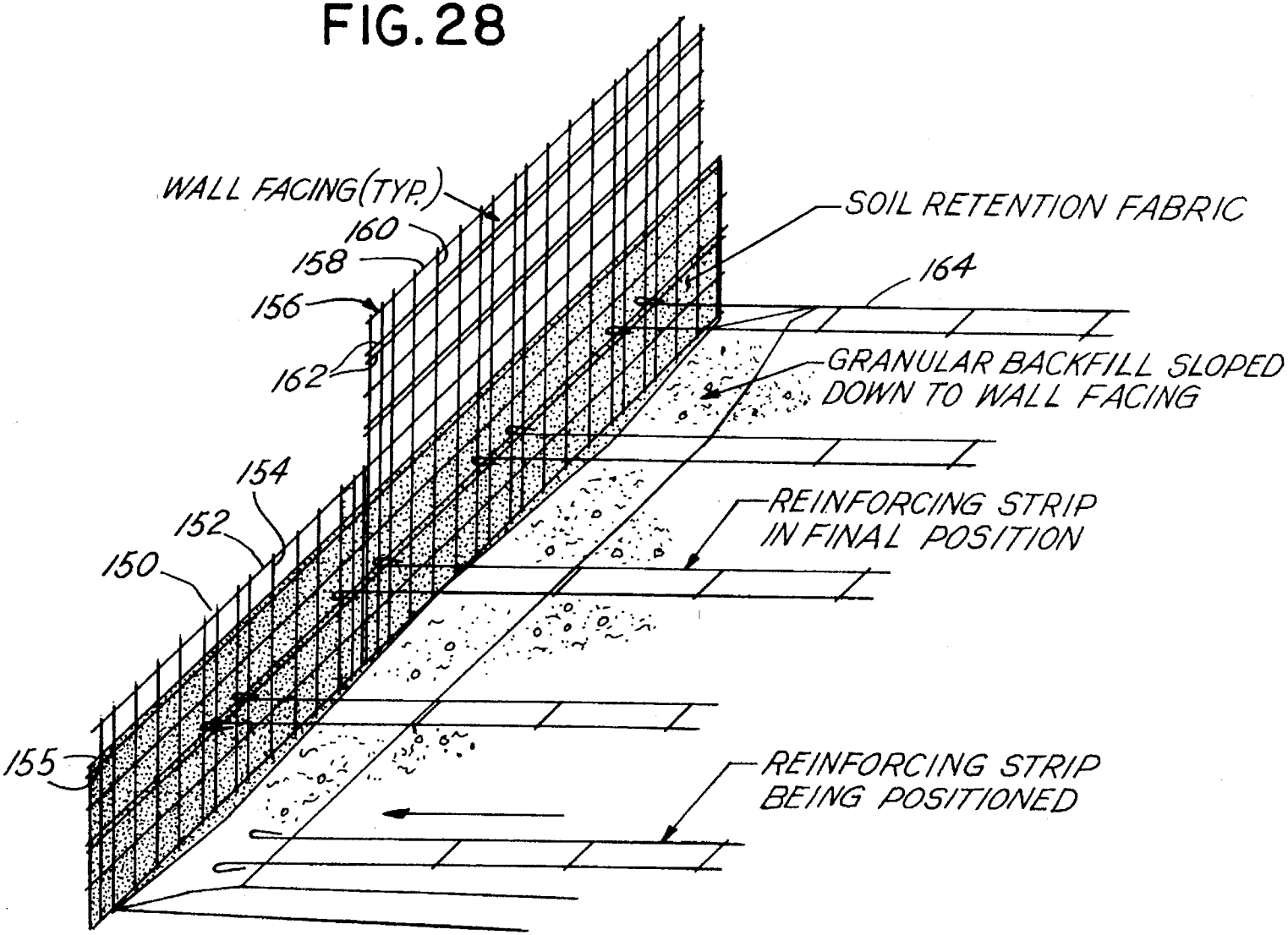
FIG. 28 is an isometric view of an alternative embodiment of the construction.

FIG. 28 illustrates an alternative embodiment of the construction of the invention wherein the earthen work bulk form 10 is comprised of vertical panels sized and generally shaped as previously described. However, with the earthen work panels depicted in FIG. 28, the hooked vertical bars on the top edges of each of the panels have been eliminated. Thus, for example, a first vertical panel 150 includes a horizontal cross bar 152 along the top edge which is welded to various spaced vertical bar members 154, for example. Single horizontal cross bars 152 thus are arrayed at spaced intervals of panel 150. The vertical members 154 also have welded thereto horizontal reinforced cross bars 155. The cross bars 155 are spaced approximately one (1) inch in the manner previously described. A first set of the cross bars 155 are positioned closely adjacent the top cross bar 152 for panel 150. In a similar fashion, the horizontally adjacent wall panel 156 includes an upper reinforcing cross bar 158 which is welded to spaced vertical bars or members 160. Other spaced horizontal cross bars 158 are provided. Note, closely spaced, double reinforcing cross bars 162 which are arranged in sets having a horizontal array are also welded to the vertical bars 160 of panel 156. Similarly, a first set of the horizontal cross bars 162 are positioned closely adjacent the top of the panel 156.

Stabilizing members 164, having looped ends 165 and a general configuration as previously described, fit through the reinforcing cross bars 155 and/or 162 in a manner to be described. The vertical panels, such as panels 150 and 156, are connected to each other by tie wires or hog rings or other means connecting adjacent side panel vertical bars 154, 160 during the fabrication process.

Figure 29:
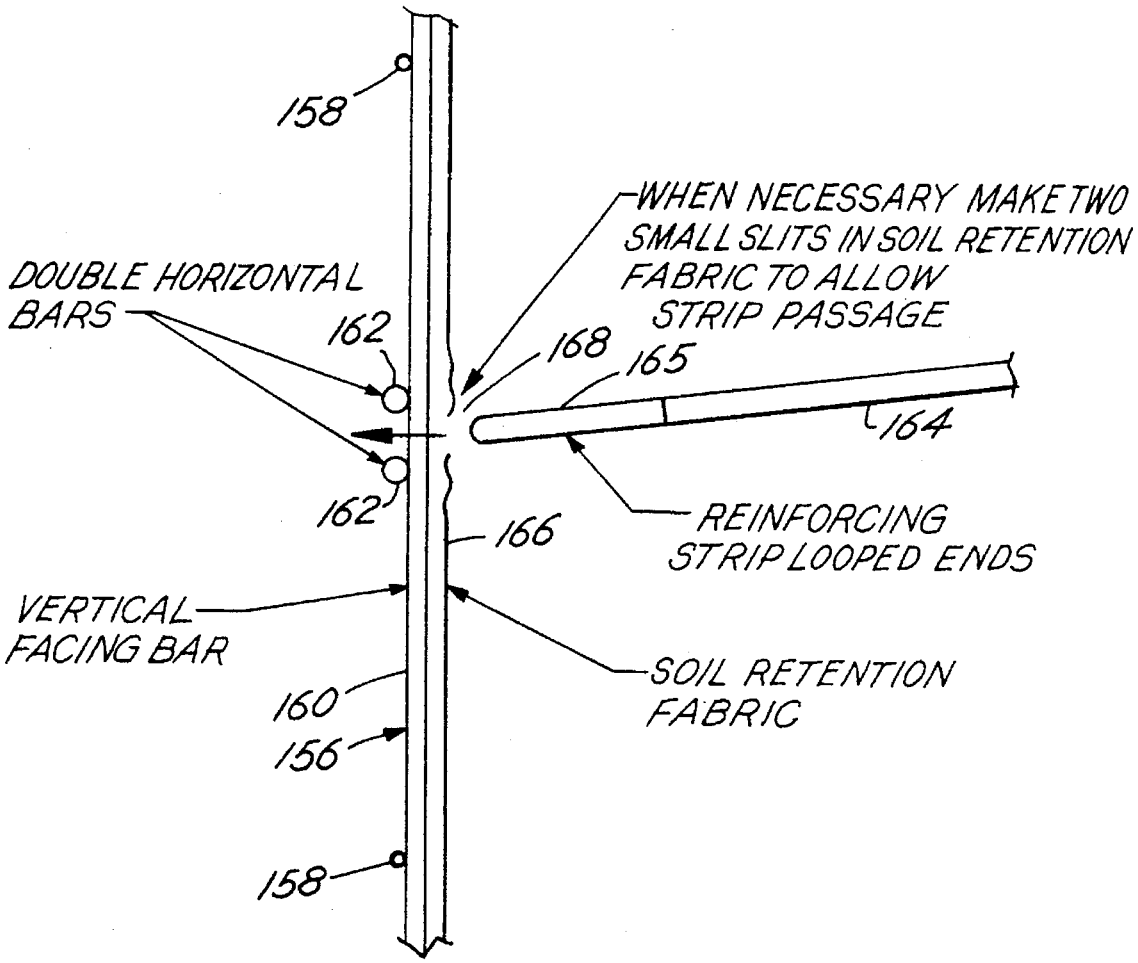
FIG. 29 is an exploded side view of component parts of the construction.

Referring now to FIG. 29, there is illustrated the manner in which the stabilizing members 164 are positioned between reinforcing cross bars 162, for example. Thus, a panel 156 which includes the reinforcing cross bars 162 receives the looped ends 165 therebetween. A soil retention fabric 166, which is placed on the inside of the panel 156, has a slit 168 cut therethrough so that the looped end 165 may be fit therethrough.

Figure 30:
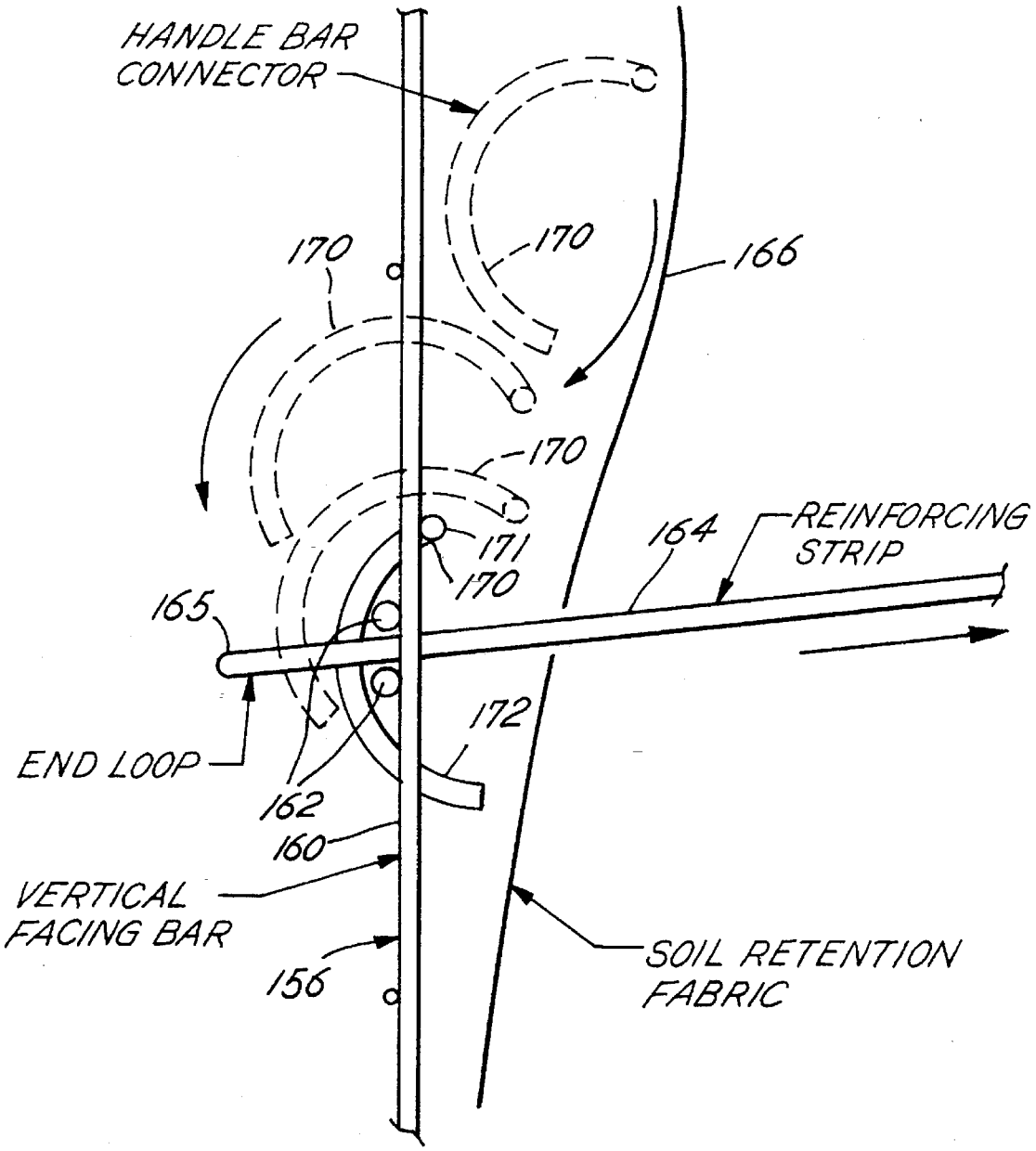
FIG. 30 is an enlarged side view of a portion of the construction illustrating the assembly of a wire facing panel with stabilizing elements.

FIG. 30 illustrates the manner in which a connector of the type generally shown in FIG. 10 is positioned to engage with the stabilizing member 164 and panel 156. Thus, a connector 170 is positioned between the soil retention fabric 166 and panel 156 in the sequential series of positions illustrated in phantom in FIG. 30. Connector ends 172 fit through the looped ends 165 and over the cross bars 162 in the manner depicted. The stabilizing element or reinforcing strip 164 may then be pulled tightly against the connector 170 to provide for the assembly depicted such as in FIG. 28. The sequential assembly steps that are followed, referring to FIG. 30 are: the top edge of the soil retention fabric 166 is pulled away from the panel or facing 156. A connector 170 is then inserted adjacent the fabric 166 into loops 165. The connection is secured by firmly pulling on the stabilizing element 164 until the connector 170 is engaged with both of the double horizontal reinforcing bars 162. The connection is complete when the cross bar portion 171 of the connector 170 is located close to the vertical bars 160.

Figure 31:
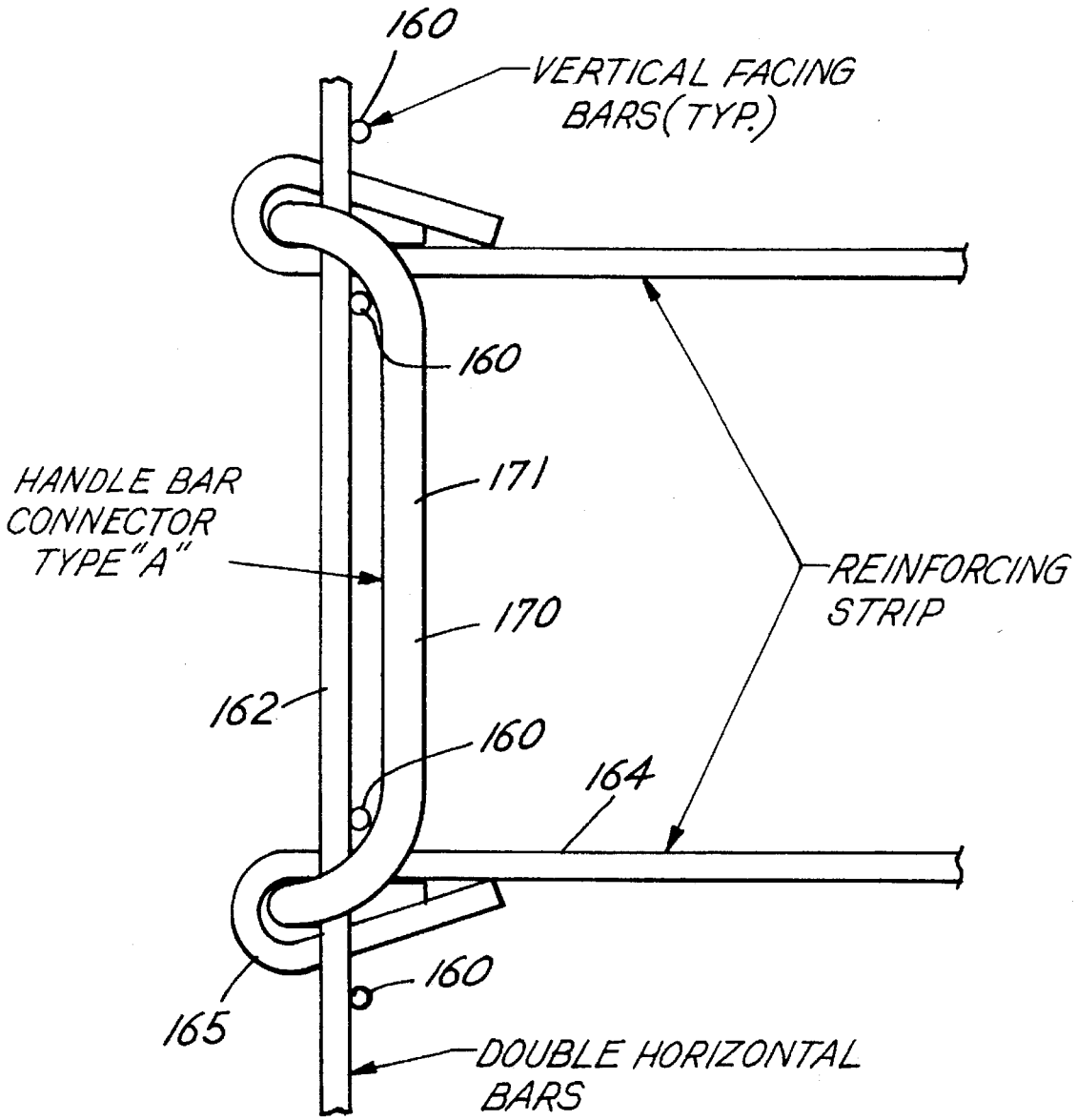
FIG. 31 is a top sectional view of FIG. 30.

FIG. 31 is a top plan view of the construction of FIG. 30. The connection is depicted in its final position as viewed from above.

Figure 32:
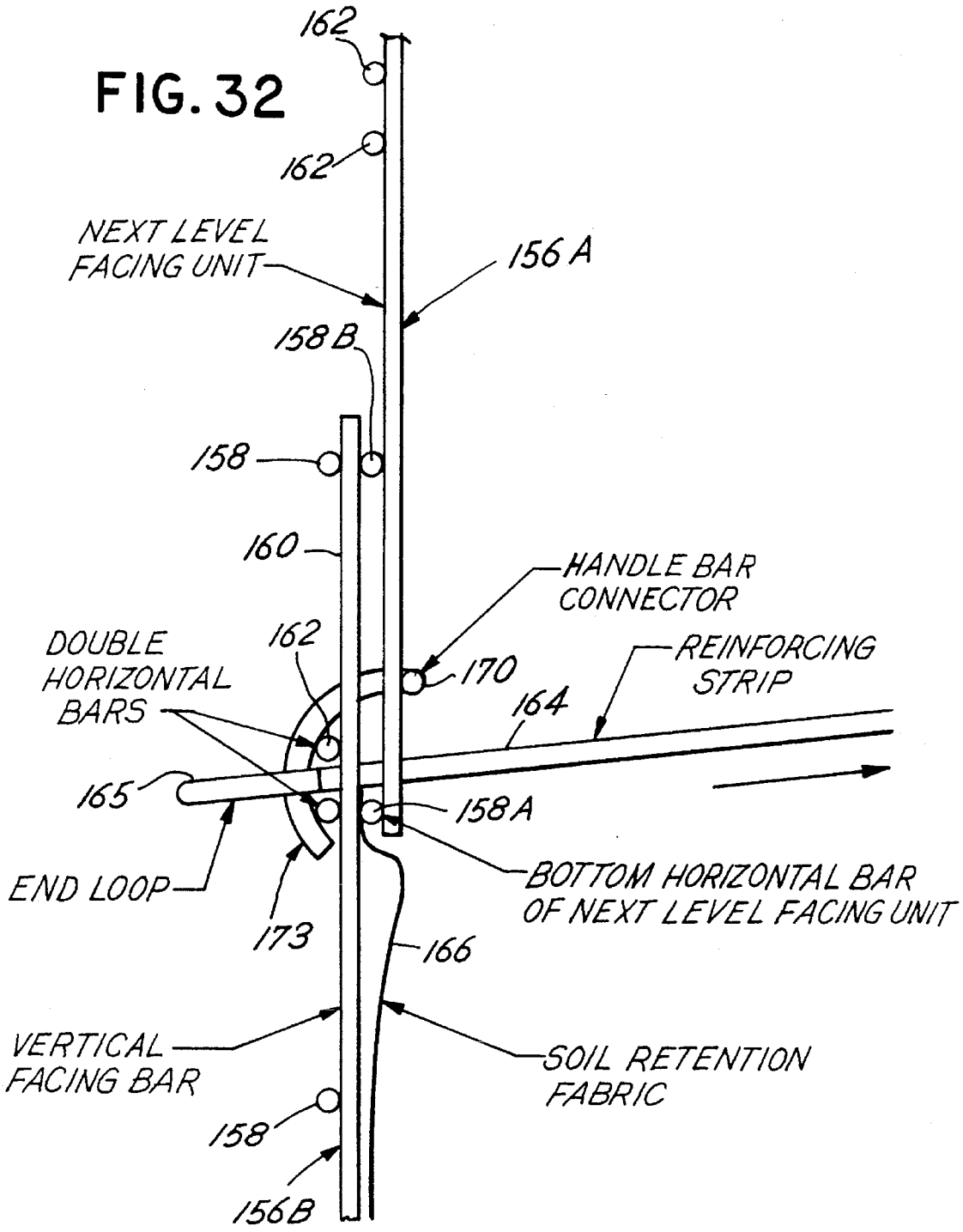
FIG. 32 is a side view of two wire mesh facing panels joined to and by a stabilizing element.

FIG. 32 illustrates the connection of vertically adjacent grids or panels, such as panels 156, by means of the connector 170 coacting with the adjacent panels. This is an embodiment generally of the type depicted in FIG. 28 which eliminates the hooks associated with the vertical rods 160. For example, hooks 44 in FIG. 5 are not utilized in the embodiment of FIGS. 28 and 32.

Referring to FIG. 32, the connector 170 is positioned through a panel 156A positioned above a second inside panel 156B. The upper panel 156A has its lower edge inside the upper edge of the lower panel 156B. The connector 170 includes end hooks or arms 173 which engage through the end loops 165 in the manner previously described. The bottom horizontal bar 158A of the inner panel 156A is positioned below the stabilizing member or element 164. The next adjacent horizontal bar 158B is positioned above the stabilizing element 164. The stabilizing element 164 is thus between the spaced horizontal bars 158A and 158B of the inner panel or upper panel 156A. This provides for a vertical range of movement of the upper panel 156 with respect to the lower panel 156 during the assembly process. This range is limited by the cross bars 158A and 158B illustrated in FIG. 32. Note, there are no closely spaced (one (1) inch spacing) reinforcing bars 162 adjacent the bottom of panel 156A.

The loops 165 fit between the slightly spaced horizontal cross bars 162 of the lower outside panel 156B and coact with the connector as previously described. In this manner, the connector 170 and stabilizing element coact with both panels 156A, 156B to hold them together.

Figure 33:
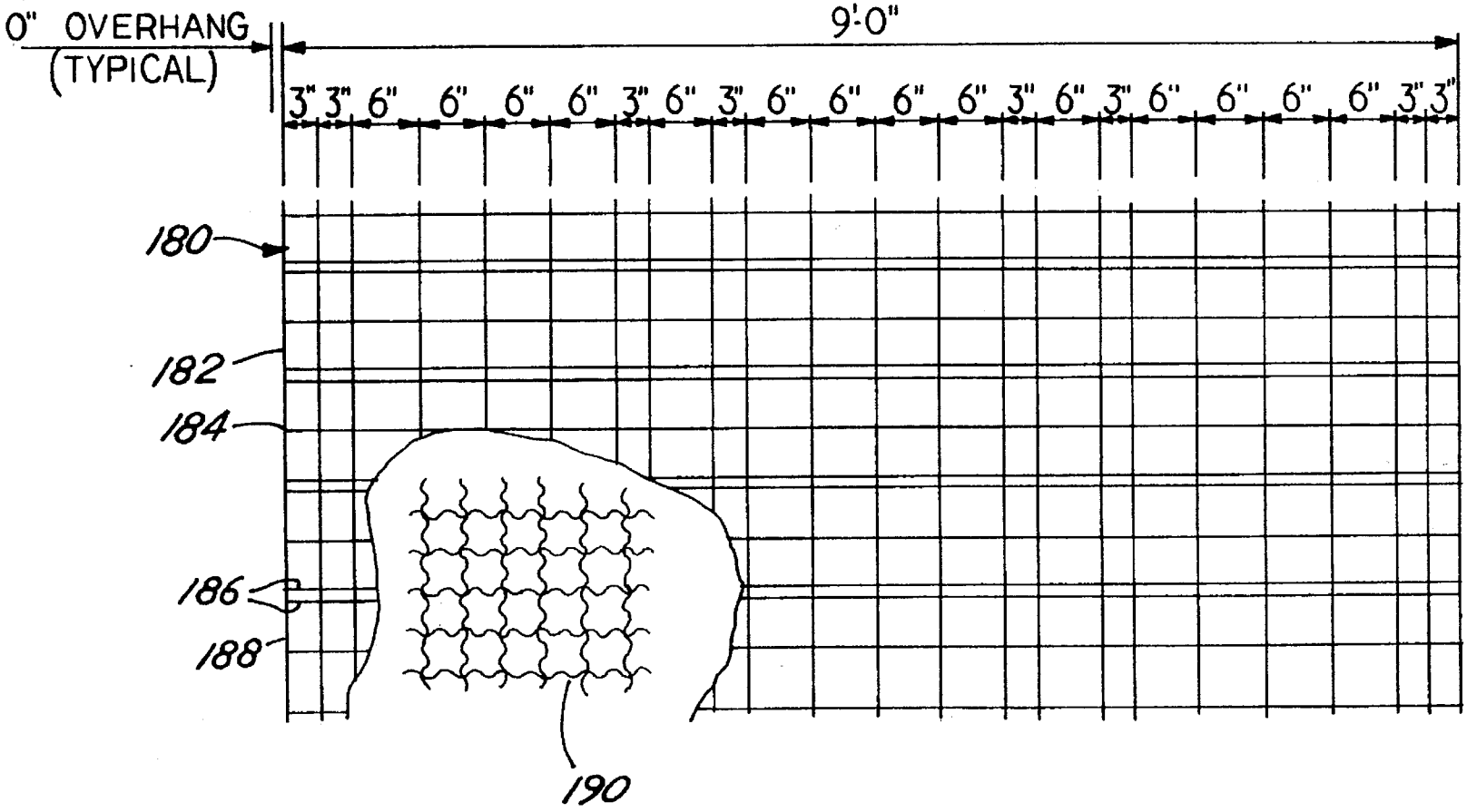
FIG. 33 is an enlarged elevation of a wire mesh panel with an alternative soil retention screen.

Referring now to FIG. 33 there is depicted an enlarged section of the construction of a wire mesh panel 180 used for the front face of the earthen bulk work form. As depicted in this figure, the panel 180 includes vertical reinforcing rods 182 and horizontal cross rods 184. At various spaced intervals, horizontal reinforcing bars 186 are arrayed in close parallel arrangement separated approximately the distance of one (1) inch. The panel 180 is designed to have a zero (0) or no overhang along its vertical side edges, for example, side edge 188 which is defined by the vertical bar 182. In this manner, panels 180 may be connected together with the vertical bars 182 arranged side by side in the facing of the earthen bulk work form. The vertical reinforcing bars such as bars 182 will, thus, be connected by means of a hog ring, wire tie or other connecting member. Additionally, as previously discussed, the stabilizing members 164 having the looped ends 165 may be fitted between horizontal reinforcing bars 186 of horizontally adjacent panels 180 to thereby effect connection between such adjacent panels 180.

As also depicted in FIG. 33, a perforated or expanded metal sheet 190 may be inserted on the inside or along the inside surface of panel 180 during the erection process for the earthen work bulk form 10. That is, the perforated screen 190 may be used in lieu of a fabric, for example, in order to retain particulate material forming the earthen work bulk form 10. In this manner, it will be seen that the construction of the invention will be comprised of only a first wire lattice work such as the panel 180 and a second adjoining or abutting perforated metal sheet 190. With this construction, it is thus possible to provide an earthen work bulk form 10 having only two (2) outside layers rather than three (3) as depicted in various prior art constructions.

Figure 34:
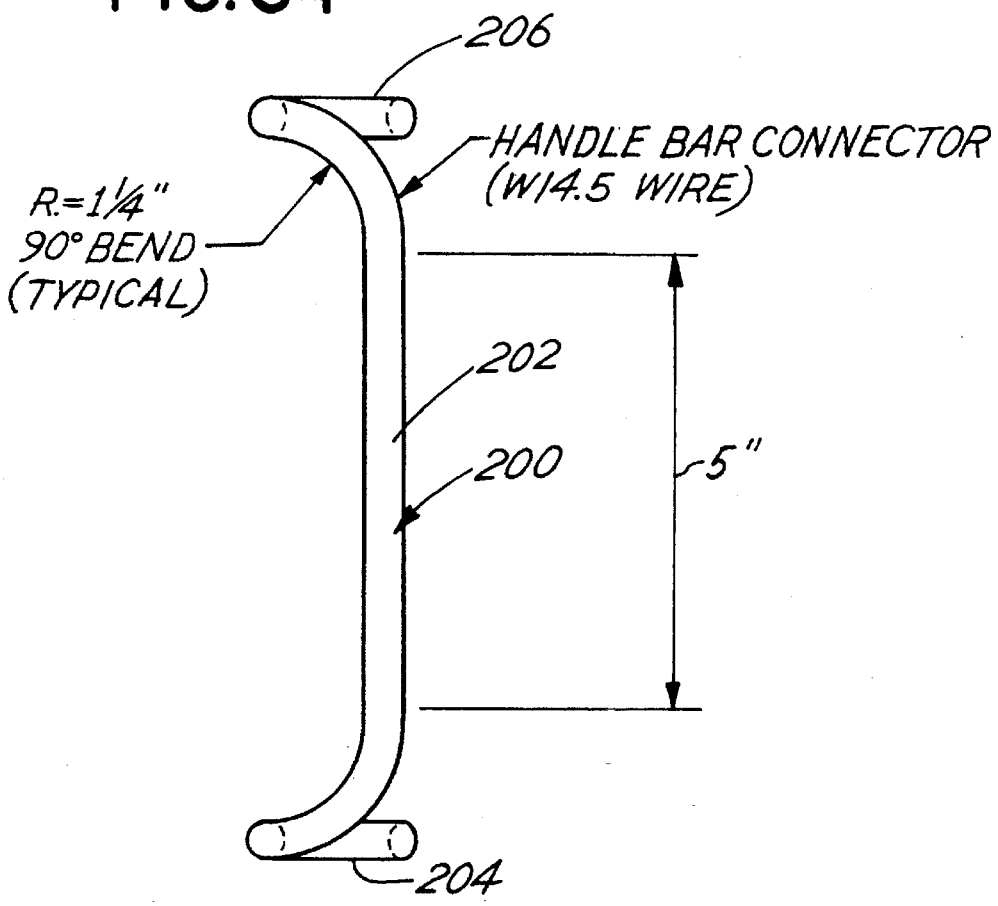
FIG. 34 is a top view of an alternative connecting hook or connector.
Figure 35:
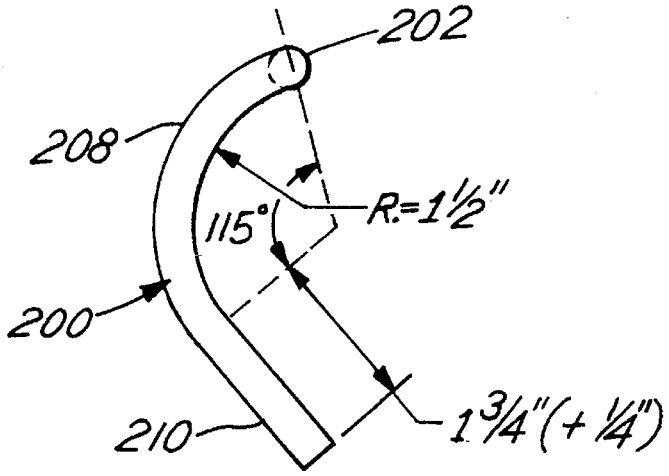
FIG. 35 is a side view of the connector of FIG. 34.

FIGS. 34 and 35 illustrate in greater detail an alternative handle bar connector 200 which is used to connect stabilizing elements 164 and more particularly the looped ends 165 thereof to a front wall lattice work or panel.. The connector 200 includes a cross bar 202 which separates the locking ends 204 and 206. The cross bar 202 is appropriately dimensioned to maintain the ends 204, 206 spaced substantially identical to the spacing of the looped ends 165 of the stabilizing elements 164 previously described. It is possible to use and construct connectors having other lengths which would cooperate with separated stabilizing elements.

In any event, each of the looped ends 204 and 206 has a special construction in the embodiment of FIGS. 34 and 35. That construction provides for an arcuate extension 208 from the cross members 202. The arcuate extension 208 has an arcuate extent of approximately one hundred fifteen (115)degrees. This arcuate extension may be varied. The range of the arcuate extension is preferably greater than ninety (90) degrees and may extend up to one hundred eighty (180) degrees. A straight end run 210 extends from the arcuate extension 208. As will be seen by reference to the prior figure, the connector 200 fits through the looped ends 165 of the stabilizing element 164 to connect the element 164 to a wall panel. The handle bar connector 200, as depicted in FIGS. 34 and 35, is especially useful in various circumstances for facilitating the ease of assembly of the component parts. For example, the extension 210 of the connector 200 is so constructed that it does not pass through the fabric or screen lining the inside of the vertical panels.

FIGS. 36 and 37 disclose an alternative connector which is used for a cast in place wall. Referring to FIGS. 36 and 37, the connector 220 includes a cross bar 222. A downward extension 224 from each end of the cross bar 222 forms a bend 226 without any connecting length between the opposite sides of the bend 226. In other words, the bend 226 is an arcuate extension of downward extension 224 as depicted in FIG. 36. This is in contrast with the construction of FIG. 25 wherein the arcuate end or extension of the member 234 is defined by two separated ninety (90) degree bends rather than a one hundred eighty (180) degree bend.

Thus while it has been set forth, preferred embodiments of the invention, it is to be understood that numerous alternatives are within the scope of the invention and thus the invention is to be limited only by the following claims and their equivalents.

What is claimed is:

1. A wall construction having a wire mesh facing, said construction comprising, in combination:

a granular, compactable fill defining a three dimensional earthen work bulk form having a generally planar front face extending upwardly from a datum plane;

said earthen work bulk form including a plurality of earth stabilizing members dispersed throughout the bulk form, said stabilizing members extending generally horizontally from the front face into the bulk form, at least some of said stabilizing members comprising first and second tensile members extending from the front face into the bulk form, said first and second tensile members including loops at the end of said members adjacent the front face and further including a wire connector fitted through the loops on the outside of the front face;

a plurality of generally vertical planar wire mesh panels on the front face, said panels defining vertical courses of connected panels, having generally horizontal side edges and vertical side edges, the vertical side edges being generally aligned and the horizontal side edges of adjacent panels being offset; and means for connecting the tensile members to the panel members.

2. The wall construction of claim 1 including wire mesh base panels along the bottom front edge of the earthen work bulk form, said base panels having a vertical run at least in part on the front face, and a horizontal run at least in part on the bottom surface of the bulk form.

3. The wall construction of claim 1 wherein the first and second tensile members further comprise, respectively, first and second rod members extending into the bulk form, and cross members connecting the rod members.

4. The wall construction of claim 1 wherein the stabilizing members comprise tension members of substantially uniform length in the earthen work bulk form.

5. The wall construction of claim 1 wherein the stabilizing members comprise tension members of different length in the earthen work bulk.

6. The wall construction of claim 1 wherein the panels have a generally equal vertical height and wherein horizontally adjacent panels are offset approximately one half of their height.

7. The wall construction of claim 1 wherein the wire mesh panels include a horizontal top edge which is hooked to cooperatively engage the horizontal bottom edge of the vertically adjacent panel.

8. The wall construction of claim 1 wherein at least some stabilizing members extend horizontally for the depth of the bulk form.

9. The wall construction of claim 1 wherein at least some of the stabilizing members extend horizontally only partially into the bulk form.

10. The wall construction of claim 1 wherein a single stabilizing member simultaneously connects with two horizontally adjacent panels.

11. The wall construction of claim 1 wherein the panels include a hooked rod member along the top edge of the panel for fitting over a generally horizontal cross bar at the bottom of the next adjacent panel whereby the panels are slightly vertically slidable with respect to one another to minimize outward bulging of the panels resulting from compaction of the particulate fill.

12. The wall construction of claim 1 including stabilizing members connected to a panel at horizontal cross bars along the bottom of the panel, said stabilizing members also cooperative with a hooked rod member to retain the panels vertically in position.

13. A method for construction of an earthen work bulk form wall construction having a wire mesh facing, comprising the steps of:

(a) forming a datum plane for the earthen work bulk form;

(b) laying a course of wire mesh base members having a generally vertical panel and a connected horizontal panel, said vertical panel generally defining a front face of the earthen work bulk form;

(c) attaching horizontally alternating height facing panels of wire mesh continuously along the vertical panel of the base members generally along the front face to define a first course of facing panels;

(d) back filling granular material behind the front face to a first level;

(e) attaching a plurality of earth stabilizing members to the facing panels for extending into the earthen work and over the first layer of granular material;

(f) attaching vertical wire mesh facing panel members to the alternating lower height facing panel members of the first course;

(g) back filling granular material behind the front face; and (h) attaching a plurality of earth stabilizing members to the facing over the back fill.

14. The method of claim 13 including the step of alternately back filling and attaching stabilizing members to the facing of each facing panel.

15. The method of claim 13 including the step of alternately attaching vertical wire mesh facing panel members to the lower height facing panels to thereby define a mosaic of facing panel members of alternating vertical height.

16. A wall construction having a wire mesh facing, said construction comprising, in combination:

a granular, compactable fill defining a three dimensional earthen work bulk form having a generally planar front face extending upwardly from a datum plane, said earthen work bulk form including a plurality of earth stabilizing members dispersed throughout the bulk form, said stabilizing members extending generally horizontally from the front face into the bulk form, at least some of said stabilizing members comprising first and second tensile members extending from the front face into the bulk form;

a plurality of generally vertical, planar wire mesh panels on the front face, said panels defining vertical courses of connected panels, having generally horizontal side edges and vertical side edges, the vertical side edges being generally aligned and the horizontal side edges of adjacent panels being offset;

means for connecting the tensile members to the panel members, said means also projecting from the panel members and from the front face; and cast in place facing material over the means for connecting and mesh panels.

17. The wall construction of claim 16 wherein the first and second tensile members include loops at the end of said members adjacent the front face, and further including a wire connector fitted through the loops on the outside of the front face.

18. The wall construction of claim 16 including wire mesh base panels along the bottom front edge of the earthen work bulk form, said base panels having a vertical run at least in part on the front face, and a horizontal run at least in part on the bottom surface of the bulk form.

19. The wall construction of claim 16, wherein the first and second tensile members further comprise, respectively, first and second rod members extending into the bulk form, and cross members connecting the rod members.

20. The wall construction of claim 16 wherein the stabilizing members comprise tension members of substantially uniform length in the earthen work bulk form.

21. The wall construction of claim 16 wherein the stabilizing members comprise tension members of different length in the earthen work bulk.

22. The wall construction of claim 16 wherein the panels have a generally equal vertical height and wherein horizontally adjacent panels are offset approximately one half of their height.

23. The wall construction of claim 16 wherein the wire mesh panels include a horizontal top edge which is hooked to cooperatively engage the horizontal bottom edge of the vertically adjacent panel.

24. The wall construction of claim 16 wherein at least some stabilizing members extend horizontally for the depth of the bulk form.

25. The wall construction of claim 16 wherein at least some of the stabilizing members extend horizontally only partially into the bulk form.

26. The wall construction of claim 16 wherein a single stabilizing member simultaneously connects with two horizontally adjacent panels.

27. The wall construction of claim 16 wherein the panels include a hooked rod member along the top edge of the panel for fitting over a generally horizontal cross bar at the bottom of the next adjacent panel whereby the panels are slightly vertically slidable with respect to one another to minimize outward bulging of the panels resulting from competition of the particulate fill.

28. The wall construction of claim 16 including stabilizing members connected to a panel at horizontal cross bars along the bottom of the panel, said stabilizing members also cooperative with a hooked rod member to retain the panels vertically in position.

29. The wall construction of claim 16 wherein the means for connecting the tensile members to the panel members comprise a handle bar construction coacting with tensile members and including at least one leg projecting outwardly from the wire mesh panels into the cast in place facing material.

30. The wall construction of claim 29 wherein the one leg projects generally horizontally from the wire mesh panels and further including generally transverse reinforcing members in the cast in place material supported at least in part by the horizontal leg.

31. The wall construction of claim 16 wherein tensile members include looped ends extending through the facing panels and the means for connecting comprise a bar fitted through looped ends.

32. A method for construction of an earthen work bulk form wall construction having a wire mesh facing, comprising the steps of:

(a) forming a datum plane for the earthen work bulk form;

(b) laying a course of wire mesh base members having a generally vertical panel and a connected horizontal panel, said vertical panel generally defining a front face of the earthen work bulk form;

(c) attaching horizontally alternating height facing panels of wire mesh continuously along the vertical panel of the base members generally along the front face to define a first course of facing panels;

(d) back filling granular material behind the front face to a first level;

(e) attaching a plurality of earth stabilizing members by means of connector members to the facing panels for extending into the earthen work and over the first layer of granular material, at least some of the said connector member projecting outwardly from the facing panels;

(f) attaching vertical wire mesh facing panel members to the alternating lower height facing panel members of the first course;

(g) back filling granular material behind the front face;

(h) attaching a plurality of earth stabilizing members to the facing over the back fill; and (i) casting in place an aggregate material wall against the facing panels.

33. The method of claim 32 including the step of alternately back filling and attaching stabilizing members to the facing of each facing panel.

34. The method of claim 32 including the step of alternately attaching vertical wire mesh facing panel members to the lower height facing panels to thereby define a mosaic of facing panel members of alternating vertical height.

35. The method of claim 32 including the step of supporting reinforcing members by means of the connector members before casting in place the aggregate material wall, whereby the reinforcing members are positioned within the cast in place wall.

36. A wire wail earthen work comprising, in combination:

a wire facing panel with an outside and an inside, said panel comprising a lattice of reinforcing bars defining the panel including a closely spaced pair of parallel, horizontal bars, and vertical bars connected to the horizontal bars;

a stabilizing member including parallel tension arms and at least two (2) terminal loops connected to the arms, said loops lying in the same horizontal plane for projecting between the spaced, horizontal bars of the panel, said loops extending on the outside of the panel and the stabilizing member projecting on the inside of the panel, said horizontal panel bars spaced to define a slot for receipt of said loops, said loops being laterally spaced from each other; and a connector having a cross bar and opposite hooked ends extending from the cross bar, said cross bar positioned on the inside of the panel and engaged by at least one (1) vertical bar of the panel, said hooked ends being fitted through the panel from the inside to the outside and through terminal loops of a stabilizing member on the outside of the panel to retain the stabilizing member attached to the panel.

37. A wire wall earthen work as set forth in claim 36 wherein the stabilizing members project into compacted soil on the inside of the panel.

38. A wire wail earthen work as set forth in claim 36 including first and second wire facing panels having an inside and an outside, each panel also having vertical bars, said panels overlapping along a horizontal edge and wherein a single connector includes a cross bar on the inside of both panels where said panels overlap with the hooked ends of said connector extending through both panels and received in the loops of the stabilizing member at the outside of both overlapped panels.

39. A wire wall earthen work as set froth in claim 36 including a screen material on the inside of the panel to retain particulate material.

40. A wire wall earthen work as set forth in claim 36 including first and second side by side panels each having parallel spaced horizontal bars and vertical bars, the parallel, spaced horizontal bars of the adjacent panels aligned horizontally for receipt simultaneously of separate loops of a stabilizing member; and a single connector coacting with the stabilizing member associated with the separate, adjacent panels.

41. The wire wall of claim 36 wherein the hook ends of the connector form an arcuate curve extending from the cross bar to the outside of the panel and then toward the inside, said curve in the range of ninety (90) degrees to one hundred eighty (180) degrees.

42. The wire wall of claim 41 wherein the arcuate curve is in the range of one hundred fifteen (115) degrees ± ten (10) degrees.

43. The wire wail of claim 36 including a plurality of pairs of parallel spaced horizontal bars on a panel with a plurality of stabilizing members attached thereto by separate connectors.

44. A wire wail earthen work comprising, in combination:

a wire facing panel with an outside and an inside, said panel comprising a lattice of reinforcing bars defining the panel including a closely spaced pair of parallel, horizontal bars and vertical bars connected to the horizontal bars;

a stabilizing member including first and second tension arms, said arms terminating in first and second coplanar loops extended through the horizontal panel bars from the inside to the outside of the panel; and a connector for attaching the loops to the panel, said connector including a hook member extending through each loop for engagement with at least one of the horizontal bars through which the loop projects.

45. A wall construction having a wire mesh facing, said construction comprising, in combination:

a granular compactable fill defining a three-dimensional earthen work bulk form having a generally planar front face extending upwardly from a datum plane;

said earthen work bulk form including a plurality of earth stabilizing members dispersed throughout the bulk form, said stabilizing members extending generally horizontally from the front face into the bulk form, at least some of said stabilizing members comprising first and second tensile members extending from the front face into the bulk form;

a plurality of generally vertical, planar wire mesh panels on the front face, said panels defining vertical courses of connected panels having generally horizontal side edges and vertical side edges, the vertical side edges being generally aligned and the horizontal side edges of adjacent panels being offset;

wire mesh base panels along the bottom front edge of the earthen work bulk form, said base panels having a vertical run at least in part on the front face, and a horizontal run at least in part on the bottom surface of the bulk form; and means for connecting the tensile members to the panel members.

46. A wall construction having a wire mesh facing, said construction comprising, in combination:

a granular, compactable fill defining a three dimensional earthen work bulk form having a generally planar front face extending upwardly from a datum plane;

said earthen work bulk form including a plurality of earth stabilizing members dispersed throughout the bulk form, said stabilizing members extending generally horizontally from the front face into the bulk form, at least some of said stabilizing members comprising first and second tensile members extending from the front face into the bulk form;

a plurality of generally vertical planar wire mesh panels on the front face, said panels defining vertical courses of connected panels, having generally horizontal side edges and vertical side edges, the vertical side edges being generally aligned and the horizontal side edges of adjacent panels being offset, said wire mesh panels including a horizontal top edge which is hooked to cooperatively engage the horizontal bottom edge of the vertically adjacent panel; and means for connecting the tensile members to the panel members.

47. A wall construction having a wire mesh facing, said construction comprising, in combination:

a granular, compactable fill defining a three dimensional earthen work bulk form having a generally planar front face extending upwardly from a datum plane;

said earthen work bulk form including a plurality of earth stabilizing members dispersed throughout the bulk form, said stabilizing members extending generally horizontally from the front face into the bulk form, at least some of said stabilizing members comprising first and second tensile members extending from the front face into the bulk form;

a plurality of generally vertical planar wire mesh panels on the front face, said panels defining vertical courses of connected panels, having generally horizontal side edges and vertical side edges, the vertical side edges being generally aligned and the horizontal side edges of adjacent panels being offset; and means for connecting the tensile members to the panel members at least one stabilizing member simultaneously connecting with two horizontally adjacent wire mesh panels.

48. A wall construction having a wire mesh facing, said construction comprising, in combination:

a granular, compactable fill defining a three dimensional earthen work bulk form having a generally planar front face extending upwardly from a datum plane;

said earthen work bulk form including a plurality of earth stabilizing members dispersed throughout the bulk form, said stabilizing members extending generally horizontally from the front face into the bulk form, at least some of said stabilizing members comprising first and second tensile members extending from the front face into the bulk form;

a plurality of generally vertical planar wire mesh panels on the from face, said panels defining vertical courses of connected panels, having generally horizontal side edges and vertical side edges, the vertical side edges being generally aligned and the horizontal side edges of adjacent panels being offset; and means for connecting the tensile members to the panel members, wherein panels include a hook rod member along the top edge thereof for fitting over a generally horizontal cross bar along the bottom of the next vertically adjacent panel, the vertically adjacent panels being slightly vertically slidable with respect to one another to minimize outward bulging of the panels resulting from compaction of the particulate fill.

49. A wall construction having a wire mesh facing, said construction comprising, in combination:

a granular, compactable fill defining a three dimensional earthen work bulk form having a generally planar front face extending upwardly from a datum plane:

said earthen work bulk form including a plurality of earth stabilizing members dispersed throughout the bulk form, said stabilizing members extending generally horizontally from the front face into the bulk form, at least some of said stabilizing members comprising first and second tensile members extending from the front face into the bulk form;

a plurality of generally vertical planar wire mesh panels on the front face, said panels defining vertical courses of connected panels, having generally horizontal side edges and vertical side edges, the vertical side edges being generally aligned and the horizontal side edges of adjacent panels being offset; and means for connecting the tensile members to the panel members, at least some of said panels including horizontal cross bars along the bottom edge of the panel, at least some of said stabilizing members connected to said horizontal cross bars, and also including a hooked rod member cooperative with said stabilizing members to retain said panels vertically in position.

* * * * *